US007636448B2

(12) United States Patent
Metcalf

(10) Patent No.: US 7,636,448 B2
(45) Date of Patent: Dec. 22, 2009

(54) SYSTEM AND METHOD FOR GENERATING SOUND EVENTS

(75) Inventor: Randall B. Metcalf, Cantonment, FL (US)

(73) Assignee: Verax Technologies, Inc., Pensacola, FL (US)

( * ) Notice: Subject to any disclaimer, the term of this patent is extended or adjusted under 35 U.S.C. 154(b) by 360 days.

(21) Appl. No.: 11/260,171

(22) Filed: Oct. 28, 2005

(65) Prior Publication Data

US 2006/0109988 A1 May 25, 2006

Related U.S. Application Data

(60) Provisional application No. 60/622,695, filed on Oct. 28, 2004.

(51) Int. Cl.
*H04R 5/02* (2006.01)

(52) U.S. Cl. ..... 381/300; 381/118; 381/119; 381/120; 84/600; 715/727

(58) Field of Classification Search ..... 381/61, 381/307, 104, 26, 28, 300, 310, 98, 77, 80, 381/118, 120, 119; 84/600, 615; 715/700, 715/727, 762

See application file for complete search history.

(56) References Cited

U.S. PATENT DOCUMENTS

| | | | | |
|---|---|---|---|---|
| 257,453 | A | 5/1882 | Ader | |
| 572,981 | A | 12/1896 | Goulvin | |
| 1,765,735 | A | 6/1930 | Phinney | |
| 2,352,696 | A | 7/1944 | De Boer et al. | 381/2 |
| 2,819,342 | A * | 1/1958 | Becker | 381/26 |
| 3,158,695 | A | 11/1964 | Camras | 369/91 |
| 3,540,545 | A | 11/1970 | Herleman et al. | 181/31 |
| 3,710,034 | A | 1/1973 | Murry | 360/7 |
| 3,944,735 | A | 3/1976 | Willcocks | 179/1 |
| 4,072,821 | A | 2/1978 | Bauer | 381/23 |

(Continued)

FOREIGN PATENT DOCUMENTS

EP 0 593 228 A 4/1994

(Continued)

OTHER PUBLICATIONS

Amatriain et al., "Transmitting Audio Content as Sound Objects", AES 22nd International Conference on Virtual, Synthetic and Entertainment Audio, Music Technology Group, IUA, UPF, Barcelona, Spain, pp. 1-11.

(Continued)

*Primary Examiner*—Vivian Chin
*Assistant Examiner*—Con P Tran
(74) *Attorney, Agent, or Firm*—Pillsbury Winthrop Shaw Pittman LLP

(57) ABSTRACT

A system and method for recording and reproducing three-dimensional sound events using a discretized, integrated macro-micro sound volume for reproducing a 3D acoustical matrix that reproduces sound including natural propagation and reverberation. The system and method may include sound modeling and synthesis that may enable sound to be reproduced as a volumetric matrix. The volumetric matrix may be captured, transferred, reproduced, or otherwise processed, as a spatial spectra of discretely reproduced sound events with controllable macro-micro relationships.

41 Claims, 11 Drawing Sheets

U.S. PATENT DOCUMENTS 4,096,353 A 6/1978 Bauer ..... 381/21
4,105,865 A 8/1978 Guillory ..... 179/1
4,196,313 A * 4/1980 Griffiths ..... 381/118
4,377,101 A 3/1983 Santucci ..... 84/743
4,393,270 A 7/1983 Van Den Berg ..... 381/98
4,408,095 A 10/1983 Ariga et al. ..... 381/24
4,422,048 A 12/1983 Edwards ..... 330/109
4,433,209 A 2/1984 Kurosawa et al. ..... 381/1
4,481,660 A 11/1984 De Koning et al. ..... 381/58
4,675,906 A 6/1987 Sessler et al. ..... 381/92
4,683,591 A 7/1987 Dawson et al. ..... 381/85
4,782,471 A 11/1988 Klein ..... 367/168
5,027,403 A 6/1991 Short et al. ..... 381/306
5,033,092 A 7/1991 Sadaie ..... 381/97
5,046,101 A 9/1991 Lovejoy ..... 381/57
5,058,170 A 10/1991 Kanamori et al. ..... 381/92
5,150,262 A 9/1992 Hosokawa et al. ..... 360/48
5,212,733 A 5/1993 DeVitt et al. ..... 381/119
5,225,618 A 7/1993 Wadhams ..... 84/602
5,260,920 A 11/1993 Ide et al. ..... 369/5
5,315,060 A 5/1994 Paroutaud ..... 84/726
5,367,506 A 11/1994 Inanaga et al. ..... 369/4
5,400,405 A 3/1995 Petroff ..... 381/1
5,400,433 A 3/1995 Davis et al. ..... 704/220
5,404,406 A 4/1995 Fuchigami et al. ..... 381/17
5,452,360 A 9/1995 Yamashita et al. ..... 381/63
5,465,302 A 11/1995 Lazzari et al. ..... 381/92
5,497,425 A 3/1996 Rapoport ..... 381/18
5,506,907 A 4/1996 Ueno et al. ..... 381/18
5,506,910 A 4/1996 Miller et al. ..... 381/103
5,521,981 A 5/1996 Gehring ..... 381/17
5,524,059 A 6/1996 Zurcher ..... 381/92
5,627,897 A 5/1997 Gagliardini et al. ..... 381/71.7
5,657,393 A 8/1997 Crow ..... 381/92
5,740,260 A 4/1998 Odom ..... 381/119
5,768,393 A 6/1998 Mukojima et al. ..... 381/17
5,781,645 A 7/1998 Beale ..... 381/182
5,790,673 A 8/1998 Gossman ..... 381/71.1
5,796,843 A 8/1998 Inanaga et al. ..... 381/17
5,809,153 A 9/1998 Aylward et al. ..... 381/155
5,812,685 A 9/1998 Fujita et al. ..... 381/90
5,822,438 A 10/1998 Sekine et al. ..... 381/17
5,850,455 A 12/1998 Arnold et al. ..... 381/17
5,857,026 A 1/1999 Scheiber ..... 381/23
6,021,205 A 2/2000 Yamada et al. ..... 381/310
6,041,127 A 3/2000 Elko ..... 381/92
6,072,878 A 6/2000 Moorer ..... 381/18
6,084,168 A 7/2000 Sitrick ..... 84/477 R
6,154,549 A 11/2000 Arnold et al. ..... 381/104
6,219,645 B1 4/2001 Byers ..... 704/275
6,239,348 B1 5/2001 Metcalf ..... 84/723
6,356,644 B1 3/2002 Pollak ..... 381/371
6,444,892 B1 9/2002 Metcalf ..... 84/723
6,574,339 B1 * 6/2003 Kim et al. ..... 381/17
6,608,903 B1 8/2003 Miyazaki et al. ..... 381/17
6,664,460 B1 12/2003 Pennock et al. ..... 84/662
6,686,531 B1 2/2004 Pennock et al. ..... 84/615
6,738,318 B1 5/2004 Harris ..... 369/2
6,740,805 B2 5/2004 Metcalf ..... 84/723
6,826,282 B1 * 11/2004 Pachet et al. ..... 381/61
6,829,018 B2 12/2004 Lin et al. ..... 348/738
6,925,426 B1 8/2005 Hartmann ..... 703/5
6,990,211 B2 1/2006 Parker ..... 381/74
7,289,633 B2 10/2007 Metcalf ..... 381/17
7,383,297 B1 6/2008 Atsmon et al. ..... 709/200
7,572,971 B2 8/2009 Metcalf ..... 84/723
2001/0055398 A1 * 12/2001 Pachet et al. ..... 381/80
2003/0123673 A1 * 7/2003 Kojima ..... 381/1
2004/0111171 A1 6/2004 Jang et al. ..... 700/94
2004/0131192 A1 7/2004 Metcalf ..... 381/1
2005/0141728 A1 6/2005 Moorer ..... 381/61

FOREIGN PATENT DOCUMENTS

EP 1 416 769 5/2004

OTHER PUBLICATIONS

Amundsen, "The Propagator Matrix Related to the Kirchhoff-Helmholtz Integral in Inverse Wavefield Extrapolation", *Geophysics*, vol. 59, No. 11, Dec. 1994, pp. 1902-1909.

Avanzini et al., "Controlling Material Properties in Physical Models of Sounding Objects", ICMC'01-1 Revised Version, pp. 1-4.

Boone, "Acoustic Rendering with Wave Field Synthesis", Presented at Acoustic Rendering for Virtual Environments, Snowbird, UT, May 26-29, 2001, pp. 1-9.

Budnik, "Discretizing the Wave Equation", In *What is and what will be: Integrating Spirituality and Science*. Retrieved Jul. 3, 2003, from http:..www.mtnmath.corn/whatth/node47.html, 12 pages.

Campos, et al., "A Parallel 3D Digital Waveguide Mesh Model with Tetrahedral Topology for Room Acoustic Simulation", Proceedings of the COST G-6 Conference on Digital Audio Effects (DAFX-00), Verona, Italy, Dec. 7-9, 2000, pp. 1-6.

Caulkins et al., "Wave Field Synthesis Interaction with the Listening Environment, Improvements in the Reproduction of Virtual Sources Situated Inside the Listening Room", Proc. of the 6$^{th}$ Int. Conference on Digital Audio Effects (DAFx-03), London, U.K. Sep. 8-11, 2003, pp. 1-4.

Chopard et al., "Wave Propagation in Urban Microcells: A Massively Parallel Approach Using the TLM Method", Retrieved Jul. 3, 2003, from http://cui.unige.ch/~luthi/links/tlm/tlm.html, 1 page.

Corey et al., "An Integrated Multidimensional Controller of Auditory Perspective in a Multichannel Soundfield", presented at the 111$^{th}$ Convention of the Audio Engineering Society, New York, New York, pp. 1-10.

Davis, "History of Spatial Coding", *Journal of the Audio Engineering Society*, vol. 51, No. 6, Jun. 2003, pp. 554-569.

De Poli et al., "Abstract Musical Timbre and Physical Modeling", Jun. 21, 2002, pp. 1-21.

De Vries et al., "Auralization of Sound Fields by Wave Field Synthesis", Laboratory of Acoustic Imaging and Sound Control, pp. 1-10.

De Vries et al., "Wave Field Synthesis and Analysis Using Array Technology", Proc. 1999 IEEE Workshop on Applications of Signal Processing to Audio and Acoustics, New Paltz, New York, Oct. 17-20, 1999, pp. 15-18.

Farina et al., "Realisation of 'Virtual' Musical Instruments: Measurements of the Impulse Response of Violins Using MLS Technique", 9 pages.

Farina et al., "Subjective Comparisons of 'Virtual' Violins Obtained by Convolution", 6 pages.

Horbach et al., "Numerical Simulation of Wave Fields Created by Loudspeaker Arrays", Audio Engineering Society 107$^{th}$ Convention, New York, New York, Sep. 1999, pp. 1-16.

Kleiner et al., "Emerging Technology Trends in the Areas of the Technical Committees of the Audio Engineering Society", *Journal of the Audio Engineering Society*, vol. 51, No. 5, May 2003, pp. 442-451.

Landone at al., "Issues in Performance Prediction of Surround Systems in Sound Reinforcement Applications", Proceedings of the 2$^{nd}$ COST G-6 Workshop on Digital Audio Effects (DAFx99), NTNU, Trondheim, Dec. 9-11, 1999, 6 pages.

Lokki et al., "The DIVA Auralization System", Helsinki University of Technology, pp. 1-4.

"Lycos Asia Malaysia—News", printed on Dec. 3, 2001, from http://livenews.lycosasia.com/my/, 3 pages.

Martin, "Toward Automatic Sound Source Recognition: Identifying Musical Instruments", presented at the NATO Computational Hearing Advanced Study Institute, II Ciocco, Italy, Jul. 1-12, 1998, pp. 1-6.

Melchior et al., "Authoring System for Wave Field Synthesis Content Production", presented at the 115$^{th}$ Convention of the Audio Engineering Society, New York, New York, Oct. 10-13, 2003, pp. 1-10.

Miller-Daly, "What You Need to Know About 3D Graphics/Virtual Reality: Augmented Reality Explained", retrieved Dec. 5, 2003, from http://web3d.about.com/library/weekly/aa012303a.htm, 3 pages.
Muller-Tomfelde, "Hybrid Sound Reproduction in Audio-Augmented Reality", AES 22nd International Conference on Virtual, Synthetic and Entertainment Audio, pp. 1-6.
Neumann et al., "Augmented Virtual Environments (AVE) for Visualization of Dynamic Imagery", Integrated Media Systems Center, Los Angeles, California, 5 pages.
"New Media for Music: An Adaptive Response to Technology", *Journal of the Audio Engineering Society*, vol. 51, No. 6, Jun. 2003, pp. 575-577.
Nicol et al., "Reproducing 3D-Sound for Videoconferencing: a Comparison Between Holophony and Ambisonic", France Telecom CNET Lannion, 4 pages.
Riegelsberger et al. Advancing 3D Audio Through an Acoustic Geometry Interface, 6 pages.
"Brains of Deaf People Rewire to 'Hear' Music", *ScienceDaily Magazine*, University of Washington, Nov. 28, 2001, 2 pages.
Smith, "Deaf People Can 'Feel' Music: Might Explain How Some Are Able to Become Performers", retrieved Dec. 3, 2001, from http://my.webmd.com/printing/article/1830.50576 1 page.
Sontacchi et al., "Enhanced 3D Sound Field Synthesis and Reproduction System by Compensating Interfering Reflections", Proceedings of the COST G-6 Conference on Digital Audio Effects (DAFX-00, Verona, Italy, Dec. 7-9, 2000, pp. 1-6.
Spors et al., "High-Quality Acoustic Rendering with Wave Field Synthesis", University of Erlangen-Nuremberg, Erlangen, Germany, Nov. 20-22, 2002, 8 pages.
Theile, "Spatial Perception in WFS Rendered Sound Fields", 2 pages.
Theile et al., "Potential Wavefield Synthesis Applications in the Multichannel Stereophonic World", AES 24th International Conference on Multichannel Audio, pp. 1-15.
Toole, "Direction and Space, the Final Frontiers: How Many Channels do We Need to be Able to Believe that We are 'There'?", Harman International Industries, Northridge, California, pp. 1-30.
Toole, "Audio-Science in the Service of Art," Harman International Industries, Northridge, California, pp. 1-23.
Tsingos etal., "Validation of Acoustical Simulations in the 'Bell Labs Box'", Bell Laboratories-Lucent Technologies, 7 pages.
University of York Music Technology Research Group, "Surrounded by Sound—A Sonic Revolution", retrieved Feb. 10, 2004, from http://www-users.york.ac.uk/~dtm3/RS/RSweb.htm, 7 pages.
Vaananen, "User Interaction and Authoring of 3D Sound Scenes in the Carrouso EU Project", Audio Engineering Society Convention Paper 5764, Presented at the 114th Convention, Mar. 22-25, 2003, pp. 1-9.
Vaananen et al., "Encoding and Rendering of Perceptual Sound Scenes in the Carrouso Project", AES 22nd International Conference on Virtual, Synthetic and Entertainment Audio, pp. 1-9.
"Virtual and Synthetic Audio: The Wonderful World of Sound Objects", *Journal of Audio Engineering Society*, vol. 51, No. 1/2, Jan./Feb. 2003, pp. 93-98.
Wittek, "Optimised Phantom Source Imaging of the High Frequency Content of Virtual Sources in Wave Field Synthesis", A Hybrid WFS/Phantom Source Solution to Avoid Spatial Aliasing, Munich, Germany: Institut fur Rundfunktechnik, 2002 pp. 1-10.
Wittek, "Perception of Spatially Synthesized Sound Fields", University of Surrey—Institute of Sound Recording, Guildford, Surrey, UK, Dec. 2003, pp. 1-43.
Young, "Networked Music: Bridging Real and Virtual Space", Peabody Conservatory of Music, Johns Hopkins University, Baltimore, Maryland, 4 pages.
"Discretizing of the Huygens Principle", retrieved Jul. 3, 2003, from http://cui.uniqe.ch/~luthi/links/tlm/node3.htm1, 2 pages.
"The Dispersion Relation", retrieved May 14, 2004, from http://cui.unige.ch/~luthi/links/tlm/node4.html, 3 pages.
Davis, "History of Spatial Coding", *Journal of the Audio Engineering Society*, vol. 51, No. 6, Jun. 2003, pp. 554-569.
De Poli et al., "Abstract Musical Timbre and Physical Modeling", Jun. 21, 2002, pp. 1-21.
De Vries et al., "Auralization of Sound Fields by Wave Field Synthesis", Laboratory of Acoustic Imaging and Sound Control, pp. 1-10.
De Vries et al., "Wave Field Synthesis and Analysis Using Array Technology", Proc. 1999 IEEE Workshop on Applications of Signal Processing to Audio and Acoustics, New Paltz, New York, Oct. 17-20, 1999, pp. 15-18.
Farina et al., "Realisation of 'Virtual' Musical Instruments: Measurements of the Impulse Response of Violins Using MLS Technique", 9 pages.
Farina et al., "Subjective Comparisons of 'Virtual' Violins Obtained by Convolution", 6 pages.
Holt, "Surround Sound: The Four Reasons", *The Absolute Sound*, Apr./May 2002, pp. 31-33.
Horbach et al., "Numerical Simulation of Wave Fields Created by Loudspeaker Arrays", Audio Engineering Society 107th Convention, New York, New York, Sep. 1999, pp. 1-16.
Kleiner et al., "Emerging Technology Trends in the Areas of the Technical Committees of the Audio Engineering Society", *Journal of the Audio Engineering Society*, vol. 51, No. 5, May 2003, pp. 442-451.
Landone et al., "Issues in Performance Prediction of Surround Systems in Sound Reinforcement Applications", Proceedings of the 2nd COST G-6 Workshop on Digital Audio Effects (DAF×99), NTNU, Trondheim, Dec. 9-11, 1999,6 pages.
Lokki et al., "The Diva Auralization System", Helsinki University of Technology, pp. 1-4.
"Lycos Asia Malaysia - News", printed on Dec. 3, 2001, from http://livenews.lycosasia.com/my/, 3 pages.
Martin, "Toward Automatic Sound Source Recognition: Identifying Musical Instruments", presented at the NATO Computational Hearing Advanced Study Institute, II Ciocco, Italy, Jul. 1-12, 1998, pp. 1-6.

* cited by examiner

SYSTEM AND METHOD FOR GENERATING SOUND EVENTS

RELATED APPLICATIONS

This application claims priority from U.S. Provisional Patent Application Ser. No. 60/622,695, filed Oct. 28, 2004, and entitled "System and Method for Recording and Reproducing Sound Events Based on Macro-Micro Sound Objectives," which is incorporated herein by reference.

This application is related to U.S. Provisional Patent Application Ser. No. 60/414,423, filed Sep. 30, 2002, and entitled "System and Method for Integral Transference of Acoustical Events"; U.S. patent application Ser. No. 08/749,766, filed Dec. 20, 1996, and entitled "Sound System and Method for Capturing and Reproducing Sounds Originating From a Plurality of Sound Sources"; U.S. patent application Ser. No. 10/673,232, filed Sep. 30, 2003, and entitled "System and Method for Integral Transference of Acoustical Events"; U.S. patent application Ser. No. 10/705,861, filed Dec. 13, 2003, and entitled "Sound System and Method for Creating a Sound Event Based on a Modeled Sound Field"; U.S. Pat. No. 6,239,348, issued May 29, 2001, and entitled "Sound System and Method for Creating a Sound Event Based on a Modeled Sound Field"; U.S. Pat. No. 6,444,892, issued Sep. 3, 2002, and entitled "Sound System and Method for Creating a Sound Event Based on a Modeled Sound Field"; U.S. Pat. No. 6,740,805, filed May 25, 2004, and entitled "Sound System and Method for Creating a Sound Event Based on a Modeled Sound Field"; each of which is incorporated herein by reference.

FIELD OF THE INVENTION

The invention relates generally to a system and method for generating three-dimensional sound events using a discretized, integrated macro-micro sound volume for reproducing a 3D acoustical matrix that produces sound with natural propagation and reverberation.

BACKGROUND OF THE INVENTION

Sound reproduction in general may be classified as a process that includes sub-processes. These sub-processes may include one or more of sound capture, sound transfer, sound rendering and other sub-processes. A sub-process may include one or more sub-processes of its own (e.g. sound capture may include one or more of recording, authoring, encoding, and other processes). Various transduction processes may be included in the sound capture and sound rendering sub-processes when transforming various energy forms, for example from physical-acoustical form to electrical form then back again to physical-acoustical form. In some cases, mathematical data conversion processes (e.g. analog to digital, digital to analog, etc.) may be used to convert data from one domain to another, such as, various types of codecs for encoding and decoding data, or other mathematical data conversion processes.

The sound reproduction industry has long pursued mastery over transduction processes (e.g. microphones, loudspeakers, etc.) and data conversion processes (e.g. encoding/decoding). Known technology in data conversion processes may yield reasonably precise results with cost restraints and medium issues being primary limiting factors in terms of commercial viability for some of the higher order codecs. However, known transduction processes may include several drawbacks. For example, audio components, such as, microphones, amplifiers, loudspeakers, or other audio components, generally imprint a sonic type of component colorization onto an output signal for that device which may then be passed down the chain of processes, each additional component potentially contributing its colorizations to an existing signature. These colorizations may inhibit a transparency of a sound reproduction system. Existing system architectures and approaches may limit improvements in this area.

A dichotomy found in sound reproduction may include the "real" versus "virtual" dichotomy in terms of sound event synthesis. "Real" may be defined as sound objects, or objects, with physical presence in a given space, whether acoustic or electronically produced. "Virtual" may be defined as objects with virtual presence relying on perceptional coding to create a perception of a source in a space not physically occupied. Virtual synthesis may be performed using perceptual coding and matrixed signal processing. It may also be achieved using physical modeling, for instance with technologies like wave-field synthesis which may provide a perception that objects are further away or closer than the actual physical presence of an array responsible for generating the virtual synthesis. Any synthesis that relies on creating a "perception" that sound objects are in a place or space other than where their articulating devices actually are may be classified as a virtual synthesis.

Existing sound recording systems typically use a number of microphones (e.g. two or three) to capture sound events produced by a sound source, e.g., a musical instrument and provide some spatial separation (e.g. a left channel and a right channel). The captured sounds can be stored and subsequently played back. However, various drawbacks exist with these types of systems. These drawbacks include the inability to capture accurately three dimensional information concerning the sound and spatial variations within the sound (including full spectrum "directivity patterns"). This leads to an inability to accurately produce or reproduce sound based on the original sound event. A directivity pattern is the resultant object radiated by a sound source (or distribution of sound sources) as a function of frequency and observation position around the source (or source distribution). The possible variations in pressure amplitude and phase as the observation position is changed are due to the fact that different field values can result from the superposition of the contributions from all elementary sound sources at the field points. This is correspondingly due to the relative propagation distances to the observation location from each elementary source location, the wavelengths or frequencies of oscillation, and the relative amplitudes and phases of these elementary sources. It is the principle of superposition that gives rise to the radiation patterns characteristics of various vibrating bodies or source distributions. Since existing recording systems do not capture this 3-D information, this leads to an inability to accurately model, produce or reproduce 3-D sound radiation based on the original sound event.

On the playback side, prior systems typically use "Implosion Type" (IMT), or push, sound fields. The IMT or push sound fields may be modeled to create virtual sound events. That is, they use two or more directional channels to create a "perimeter effect" object that may be modeled to depict virtual (or phantom) sound sources within the object. The basic IMT paradigm is "stereo," where a left and a right channel are used to attempt to create a spatial separation of sounds. More advanced IMT paradigms include surround sound technologies, some providing as many as five directional channels (left, center, right, rear left, rear right), which creates a more engulfing object than stereo. However, both are considered perimeter systems and fail to fully recreate original sounds.

Implosion techniques are not well suited for reproducing sounds that are essentially a point source, such as stationary sound sources (e.g., musical instruments, human voice, animal voice, etc.) that radiate sound in all or many directions.

With these paradigms "source definition" during playback is usually reliant on perceptual coding and virtual imaging. Virtual sound events in general do not establish well-defined interior fields with convincing presence and robustness for sources interior to a playback volume. This is partially due to the fact that sound is typically reproduced as a composite' event reproduced via perimeter systems from outside-in. Even advanced technologies like wavefield synthesis may be deficient at establishing interior point sources that are robust during intensification.

Other drawbacks and disadvantages of the prior art also exist.

SUMMARY

An object of the invention is to overcome these and other drawbacks.

One aspect of the invention relates to a system and method for recording and reproducing three-dimensional sound events using a discretized, integrated macro-micro sound volume for reproducing a 3D acoustical matrix that reproduces sound including natural propagation and reverberation. The system and method may include sound modeling and synthesis that may enable sound to be reproduced as a volumetric matrix. The volumetric matrix may be captured, transferred, reproduced, or otherwise processed, as a spatial spectra of discretely reproduced sound events with controllable macro-micro relationships.

The system and method may enable customization and an enhanced level of control over a generation, using a plurality of sound rendering engines, of a sound event that includes sounds produced by a plurality of sound objects. In order to generate the sound event, the sound objects may be obtained. Obtaining the sound objects may include obtaining information related to the sound objects themselves and the sound content produced by the sound objects during the sound event. In some embodiments, the sound objects may be user-selectable. In various instances, some or all of the information related to each of the sound objects may be adjusted by a user separately from the other sound objects to provide enhanced control over the sound event. Once the sound objects have been obtained and/or selected, they may be associated with the sound rendering devices based on the characteristics of the sound objects and the sound rendering devices (e.g., positional information, sonic characteristics, directivity patterns, etc.). In some embodiments, the associations of the sound objects and sound rendering devices may be determined and/or overridden by user-selection. The sound rendering devices may then be driven in accordance with the sound objects to generate the sound event. During the generation of the sound event each of the sound rendering devices may be independently controlled (either automatically, or by the user) to provide and enhance level of customization and control over the generation of the sound event.

The system may include one or more recording apparatus for recording a sound event on a recording medium. The recording apparatus may record the sound event as one or more discrete objects. The discrete objects may include one or more micro objects and/or one or more macro objects. A micro object may include a sound producing object (e.g. a sound source), or a sound affecting object (e.g. an object or element that acoustically affects a sound). A macro object may include one or more micro objects. The system may include one or more rendering engines. The rendering engine (s) may reproduce the sound event recorded on the recorded medium by discretely reproducing some or all of the discretely recorded objects. In some embodiments, the rendering engine may include a composite rendering engine that includes one or more nearfield rendering engines and one or more farfield engines. The nearfield rendering engine(s) may reproduce one or more of the micro objects, and the farfield rendering engine(s) may reproduce one or more of the macro objects.

According to various embodiments of the invention, a sound object may include any sound producing object or group of objects. For example, in the context of an original sound event (e.g., an orchestral concert), an object may include a single sound object that emits sound (e.g., a trumpet playing in the orchestra at the concert), or an object may include a group of sound objects that emit sound (e.g., the horn section of the orchestra). In the context of a "playback" of a sound event, an object may include a single rendering device (e.g., a lone loudspeaker or loudspeaker array), a group of rendering devices (e.g., a network of loudspeakers and/or amplifiers producing sound in a conventional 5.1 format). It may be appreciated that the term "playback" is not limited to sound events driven based on pre-recorded signals, and that in some cases sound events produced via rendering engines may be original events.

In some embodiments of the invention, sound may be modeled and synthesized based on an object oriented discretization of a sound volume starting from focal regions inside a volumetric matrix and working outward to the perimeter of the volumetric matrix. An inverse template may be applied for discretizing the perimeter area of the volumetric matrix inward toward a focal region.

More specifically, one or more of the focal regions may include one or more independent micro objects inside the volumetric matrix that contribute to a composite volume of the volumetric matrix. A micro domain may include a micro object volume of the sound characteristics of a micro object. A macro domain may include a macro object that includes a plurality of micro objects. The macro domain may include one or more micro object volumes of one or more micro objects of one or more micro domains as component parts of the macro domain. In some instances, the composite volume may be described in terms of a plurality of macro objects that correspond to a plurality of macro domains within the composite volume. A macro object may be defined by an integration of its micro objects, wherein each micro domain may remain distinct.

Because of the propagating nature of sound, sound events may be characterized as a macro-micro event. An exception may be a single source within an anechoic environment. This would be a rare case where a micro object has no macro attributes, no reverb, and no incoming waves, only outgoing waves. More typically, a sound event may include one or more micro objects (e.g. the sound source(s)) and one or more macro objects (e.g. the overall effects of various acoustical features of a space in which the original sound propagates and reverberates). A sound event with multiple sources may include multiple micro objects, but still may only include one macro object (e.g. a combination of all source attributes and the attributes of the space or volume which they occur in, if applicable).

Since micro objects may be separately articulated, the separate sound sources may be separately controlled and diagnosed. An object network may include one or more micro objects (e.g., a network of one or more loudspeakers and/or a network of one or more amplifier elements) that may also be controlled and manipulated by a common controller to achieve specific macro objectives within the object network. The common controller may control the object network automatically and/or based on manual adjustments of a user. The common controller may control objects within the network individually, and relative to each other. In theory, the micro objects and macro objects that make up an object network may be discretized to a wide spectrum of defined levels.

In some embodiments of the invention, both an original sound event and a reproduced sound event may be discretized into nearfield and farfield perspectives. This may enable articulation processes to be customized and optimized to more precisely reflect the articulation properties of an original event's corresponding nearfield and farfield objects, including appropriate scaling issues. This may be done primarily so nearfield objects may be further discretized and customized for optimum nearfield wave production on an object oriented basis. Farfield object reproductions may require less customization, which may enable a plurality of farfield objects to be mixed in the signal domain and rendered together as a composite event. This may work well for farfield sources such as, ambient effects, and other plane wave sources. It may also work well for virtual sound synthesis where perceptual cues are used to render virtual sources in a virtual environment. In some embodiments, both nearfield physical synthesis and farfield virtual synthesis may be combined. In some embodiments, objects may be selected for nearfield physical synthesis and/or farfield virtual synthesis based on one or more of a user selection, positional information for the objects, or a sonic characteristic.

In some embodiments of the invention, the system may include one or more rendering engines for nearfield articulation, which may be customizable and discretized. Bringing a nearfield engine closer to an audience may add presence and clarity to an overall articulation process. Such Volumetric discretization of micro objects within a given sound event may enhance a stability of a physical sound stage, and may also enable customization of direct sound articulation. This may enhance an overall resolution, since sounds may have unique articulation attributes in terms of wave attributes, scale, directivity, etc. the nuances of which may be magnified as intensity is increased.

In various embodiments of the invention, the system may include one or more farfield engine. The farfield engines may provide the a plurality of micro object volumes included within a macro domain related to the farfield objects of a sound event.

According to one embodiment, the two or more independent engines may work together to produce precise analogs of sound events, captured or specified, with an augmented precision. Farfield engines may contribute to this compound approach by articulating farfield objects, such as, farfield sources, ambient effects, reflected sound, and other farfield objects. Other discretized perspectives can also be applied.

For instance, in some embodiments, an exterior noise cancellation device could be used to counter some or all of a resonance created by an actual playback room. By reducing or eliminating the effects of a playback room, "double ambience" may be reduced or eliminated leaving only the ambience of an original event (or of a reproduced event if source material is recorded dry) as opposed to a combined resonating effect created when the ambience of an original event's space is superimposed on the ambience of a reproduced event's space ("double ambience").

While some or all of the micro objects may retain discreteness throughout a transference process including the final transduction process and articulation, or, selected ones of the objects may be mixed if so desired. For instance, to create a derived ambient effect, or be used within a generalized commercial template where a limited number of channels might be available, some or all of the discretely transferred objects may be mixed prior to articulation. Therefore, the data based functions including control over the object data that corresponds to a sound event may be enhanced to allow for discrete object data (dry or wet) and/or mixed object data (e.g., matrixed according to a perceptually based algorithm, matrixed based on user selection, etc.) to flow through an entire processing chain to compound rendering engine that may include one or more nearfield engines and one or more farfield engines, for final articulation. In other words, object data may be representative of three-dimensional sound objects that can be independently articulated (micro objects) in addition to being part of a combined macro object.

The virtual vs. real dichotomy (or virtual sound synthesis vs. physical sound synthesis), outlined above, may break down similar to the nearfield-farfield dichotomy. In some embodiments, virtual space synthesis in general may operate well with farfield architectures and physical space synthesis in general may operate well with nearfield architectures (although physical space synthesis may also integrate the use of farfield architectures in conjunction with nearfield architectures). So, the two rendering perspectives may be layered within a volume's space, one for nearfield articulation, the other for farfield articulation, both for macro objects, and both working together to optimize the processes of volumetric amplification among other things. Of course, this example is provided for illustrative purposes only, and other perspectives exist that may enable sound events to be discretized to various levels.

Layering the two articulation paradigms in this manner may augment the overall rendering of sound events, but may also present challenges, such as distinguishing when rendering should change over from virtual to real, or determining where the line between nearfield and farfield may lie. In order for rendering languages to be enabled to deal with these two dichotomies, a standardized template may be established defining nearfield discretization and farfield discretization as a function of layering real and virtual objects (other functions can be defined as well), resulting in a macro-micro rendering template for creating definable repeatable analogs.

While a compound rendering engine may enable an articulation process in a more object oriented integrated fashion. Other embodiments may exist. For example, a primarily physical space synthesis system may be used. In such embodiments, all, or substantially all, aspects of an original sound event may be synthetically cloned and physically reproduced in an appropriately scaled space. However, the compound approach marrying virtual space synthesis and physical space synthesis may provide various enhancements, such as, economic, technical, practical, or other enhancements. It will be appreciated though, that if enough space is available within a given playback venue, a sound event may be duplicated using physical space synthesis methods only.

In various embodiments of the invention, object oriented discretization of objects may enable improvements in scaling to take place. For example, if generalizations are required due to budget or space restraints, nearfield scaling issues may enable augmented sound event generation. Farfield sources may be processed and articulated using one or more separate rendering engines, which may also be scaled accordingly. As a result macro events may be reproduced within a given venue (room, car, etc.) using relatively small compound rendering engines designed to match the volume of the venue.

Another aspect of the invention may relate to a transparency of sound reproduction. By discretely controlling some or all of the micro objects included in a sound event, the sound event may be recreated to compensate for one or more component colorizations through equalization as the sound event is reproduced.

Another object of the present invention is to provide a system and method for capturing an object, which is produced by a sound source over an enclosing surface (e.g., approximately a 360° spherical surface), and modeling the object based on predetermined parameters (e.g., the pressure and directivity of the object over the enclosing space over time), and storing the modeled object to enable the subsequent creation of a sound event that is substantially the same as, or a purposefully modified version of, the modeled object.

Another object of the present invention is to model the sound from a sound source by detecting its object over an enclosing surface as the sound radiates outwardly from the sound source, and to create a sound event based on the modeled object, where the created sound event is produced using an array of loud speakers configured to produce an "explosion" type acoustical radiation. Preferably, loudspeaker clusters are in a 360° (or some portion thereof) cluster of adjacent loudspeaker panels, each panel comprising one or more loudspeakers facing outward from a common point of the cluster. Preferably, the cluster is configured in accordance with the transducer configuration used during the capture process and/or the shape of the sound source.

According to one object of the invention, an explosion type acoustical radiation is used to create a sound event that is more similar to naturally produced sounds as compared with "implosion" type acoustical radiation. Natural sounds tend to originate from a point in space and then radiate up to 360° from that point.

According to one aspect of the invention, acoustical data from a sound source is captured by a 360° (or some portion thereof) array of transducers to capture and model the object produced by the sound source. If a given object is comprised of a plurality of sound sources, it is preferable that each individual sound source be captured and modeled separately.

A playback system comprising an array of loudspeakers or loudspeaker systems recreates the original object. Preferably, the loudspeakers are configured to project sound outwardly from a spherical (or other shaped) cluster. Preferably, the object from each individual sound source is played back by an independent loudspeaker cluster radiating sound in 360° (or some portion thereof). Each of the plurality of loudspeaker clusters, representing one of the plurality of original sound sources, can be played back simultaneously according to the specifications of the original objects produced by the original sound sources. Using this method, a composite object becomes the sum of the individual sound sources within the object.

To create a near perfect representation of the object, each of the plurality of loudspeaker clusters representing each of the plurality of original sound sources should be located in accordance with the relative location of the plurality of original sound sources. Although this is a preferred method for EXT reproduction, other approaches may be used. For example, a composite object with a plurality of sound sources can be captured by a single capture apparatus 360° spherical array of transducers or other geometric configuration encompassing the entire composite object) and played back via a single EXT loudspeaker cluster (360° or any desired variation). However, when a plurality of sound sources in a given object are captured together and played back together (sharing an EXT loudspeaker cluster), the ability to individually control each of the independent sound sources within the object is restricted. Grouping sound sources together also inhibits the ability to precisely "locate" the position of each individual sound source in accordance with the relative position of the original sound sources. However, there are circumstances which are favorable to grouping sound sources together. For instance, during a musical production with many musical instruments involved (i.e., full orchestra). In this case it would be desirable, but not necessary, to group sound sources together based on some common characteristic (e.g., strings, woodwinds, horns, keyboards, percussion, etc.).

In applying volumetric geometry to objectively define volumetric space and direction parameters in terms of the placement of sources, the scale between sources and between room size and source size, the attributes of a given volume or space, movement algorithms for sources, etc., may be done using a variety of evaluation techniques. For example, a method of standardizing the volumetric modeling process may include applying a focal point approach where a point of orientation is defined to be a "focal point" or "focal region" for a given sound volume.

According to various embodiments of the invention, focal point coordinates for any volume may be computed from dimensional data for a given volume which may be measured or assigned. Since a volume may have a common reference point, its focal point, everything else may be defined using a three dimensional coordinate system with volume focal points serving as a common origin. Other methods for defining volumetric parameters may be used as well, including a tetrahedral mesh, or other methods. Some or all of the volumetric computation may be performed via computerized processing. Once a volume's macro-micro relationships are determined based on a common reference point (e.g. its focal point), scaling issues may be applied in an objective manner. Data based aspects (e.g. content) can be captured (or defined) and routed separately for rendering via a compound rendering engine.

For applications that occur in open space without full volumetric parameters (e.g. a concert in an outdoor space), the missing volumetric parameters may be assigned based on sound propagation laws or they may be reduced to minor roles since only ground reflections and intraspace dynamics among sources may be factored into a volumetric equation in terms of reflected sound and other ambient features. However even under these conditions a sound event's focal point (used for scaling purposes among other things) may still be determined by using area dimension and height dimension for an anticipated event location.

By establishing an area based focal point with designated height dimensions even outdoor events and other sound events not occurring in a structured volume may be appropriately scaled and translated from reference models.

These and other objects of the invention are accomplished according to one embodiment of the present invention by defining an enclosing surface (spherical or other geometric configuration) around one or more sound sources, generating a object from the sound source, capturing predetermined parameters of the generated object by using an array of transducers spaced at predetermined locations over the enclosing surface, modeling the object based on the captured parameters and the known location of the transducers and storing the modeled object. Subsequently, the stored object can be used selectively to create sound events based on the modeled object. According to one embodiment, the created sound event can be substantially the same as the modeled sound event. According to another embodiment, one or more parameters of the modeled sound event may be selectively modified.

Preferably, the created sound event is generated by using an explosion type loudspeaker configuration. Each of the loudspeakers may be independently driven to reproduce the overall object on the enclosing surface.

DETAILED DESCRIPTION OF THE DRAWINGS

One aspect of the invention relates to a system and method for recording and reproducing three-dimensional sound events using a discretized, integrated macro-micro sound volume for reproducing a 3D acoustical matrix that reproduces sound including natural propagation and reverberation. The system and method may include sound modeling and synthesis that may enable sound to be reproduced as a volumetric matrix. The volumetric matrix may be captured, transferred, reproduced, or otherwise processed, as a spatial spectra of discretely reproduced sound events with controllable macro-micro relationships.

Figure 5:
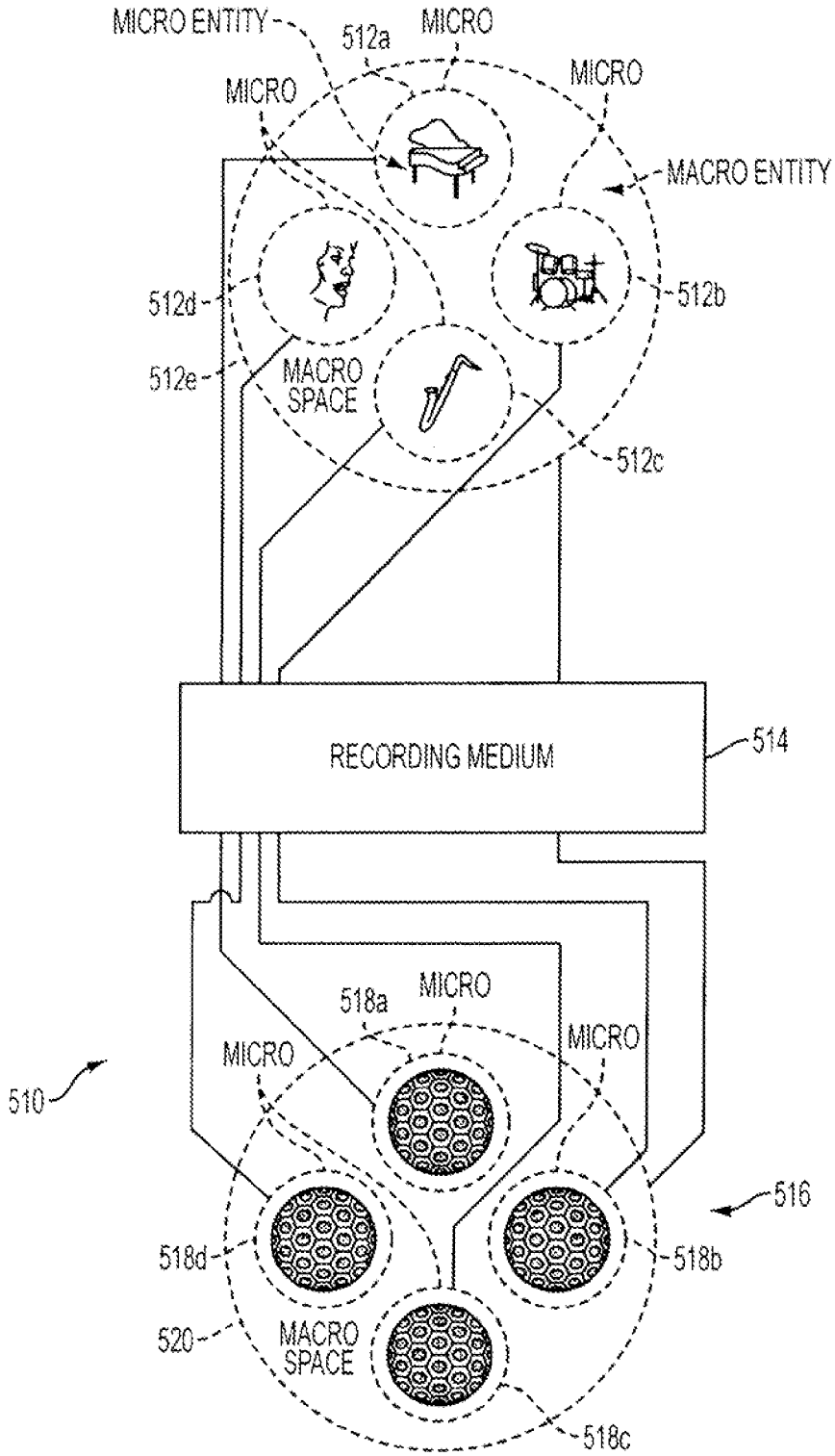
FIG. 5 is an exemplary illustration of a system for generating a sound event, in accordance with some embodiments of the invention.

FIG. 5 illustrates an exemplary embodiment of a system 510. System 510 may include one or more recording apparatus 512 (illustrated as micro recording apparatus 512*a,* micro recording apparatus 512*b,* micro recording apparatus 512*c,* micro recording apparatus 512*d,* and macro recording apparatus 512*e*) for recording a sound event on a recording medium 514. Recording apparatus 512 may record the sound event as one or more discrete objects. The discrete objects may include one or more micro objects and/or one or more macro objects. A micro object may include a sound producing object (e.g. a sound source), or a sound affecting object (e.g. an object or element that acoustically affects a sound). A macro object may include one or more micro objects. System 510 may include one or more rendering engines. The rendering engine(s) may reproduce the sound event recorded on recorded medium 514 by discretely reproducing some or all of the discretely recorded objects. In some embodiments, the rendering engine may include a composite rendering engine 516. The composite rendering engine 516 may include one or more micro rendering engines 518 (illustrated as micro rendering engine 518*a,* micro rendering engine 518*b,* micro rendering engine 518*c,* and micro rendering engine 518*d*) and one or more macro engines 520. Micro rendering engines 518*a*-518*d* may reproduce one or more of the micro objects, and macro rendering engine 520 may reproduce one or more of the macro objects.

Each micro object within the original sound event and the reproduced sound event may include a micro domain. The micro domain may include a micro object volume of the sound characteristics of the micro object. A macro domain of the original sound event and/or the reproduced sound event may include a macro object that includes a plurality of micro objects. The macro domain may include one or more micro object volumes of one or more micro objects of one or more micro domains as component parts of the macro domain. In some instances, the composite volume may be described in terms of a plurality of macro objects that correspond to a plurality of macro domains within the composite volume. A macro object may be defined by an integration of its micro objects, wherein each micro domain may remain distinct. Micro objects may be grouped into a macro object based on one or more of a user selection, positional information for the objects, or a sonic characteristic. Macro objects may be controlled during reproduction (or production, for an original sound event) individually by a common controller that manipulates the macro objects relative to each other to provide the whole of the sound event. In some instances, the common controller may enable individual control over some or all of the micro objects, and may control the macro objects relative to each other by controlling some or all of the micro objects within the macro objects individually in a coordinated manner. The common controller may control the objects automatically and/or based on manipulation of a user.

Because of the propagating nature of sound, a sound event may be characterized as a macro-micro event. An exception may be a single source within an anechoic environment. This would be a rare case where a micro object has no macro attributes, no reverb, and no incoming waves, only outgoing waves. More typically, a sound event may include one or more micro objects (e.g. the sound source(s)) and one or more macro objects (e.g. the overall effects of various acoustical features of a space in which the original sound propagates and reverberates). A sound event with multiple sources may include multiple micro objects, but still may only include one macro object (e.g. a combination of all source attributes and the attributes of the space or volume which they occur in, if applicable).

Since micro objects may be separately articulated, the separate sound sources may be separately controlled and diagnosed. In such embodiments, composite rendering apparatus 516 may form an object network. The object network may include a network of loudspeakers and/or a network of amplifier elements under common control. For example, the object network may include micro rendering engines 518*a*-518*d* as micro objects that may also be controlled and manipulated to achieve specific macro objectives within the object network. Macro rendering engine 520 may be included in the object network as a macro object that may be controlled and manipulated to achieve various macro objectives within the object network, such as, mimicking acoustical properties of a space in which the original sound event was recorded, canceling acoustical properties of a space in which the reproduced sound event takes place, or other macro objectives. In some embodiments, the micro objects and macro objects that make up an object network may be discretized to a wide spectrum of defined levels that may include grouping micro objects into macro objects based on or more of a user selection, positional information for the sound objects, a sonic characteristic, or other criteria.

In some embodiments of the invention, both an original sound event and a reproduced sound event may be discretized into nearfield and farfield perspectives. This may enable articulation processes to be customized and optimized to more precisely reflect the articulation properties of an original event's corresponding nearfield and farfield objects, including appropriate scaling issues. This may be done primarily so nearfield objects may be further discretized and customized for optimum nearfield wave production on an object oriented basis. Farfield object reproductions may require less customization, which may enable a plurality of farfield objects to be mixed in the signal domain and rendered together as a composite event. This may work well for farfield sources such as, ambient effects, and other plane wave sources. It may also work well for virtual sound synthesis where perceptual cues are used to render virtual sources in a virtual environment. In some preferred embodiments, both nearfield physical synthesis and farfield virtual synthesis may be combined. For example, micro rendering engines 518*a*-518*d* may be implemented as nearfield objects, while macro rendering engine 520 may be implemented as a farfield object. In some embodiments, objects may be implemented as nearfield objects and/or farfield objects based on one or more of a user selection, positional information for the sound objects, a sonic characteristic, or other criteria.

Figure 6A:
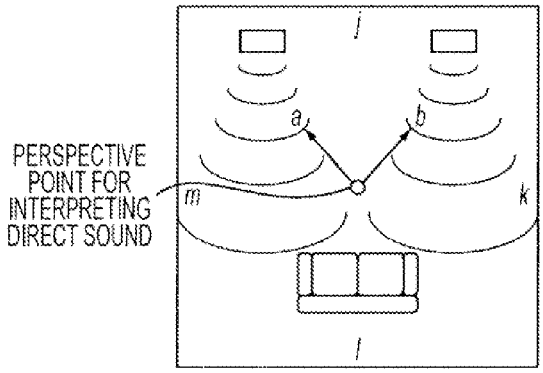
FIG. 6 illustrates several composite sound rendering engines according to some embodiments of the invention.
Figure 6B:
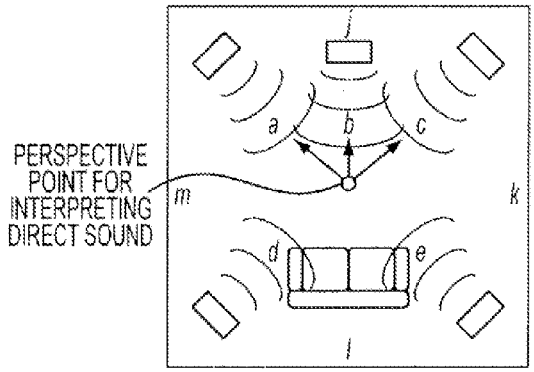
Figure 6C:
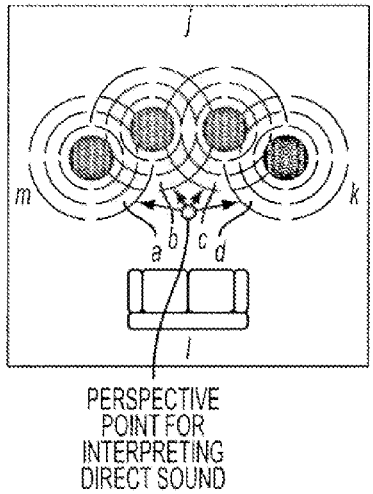
Figure 6D:
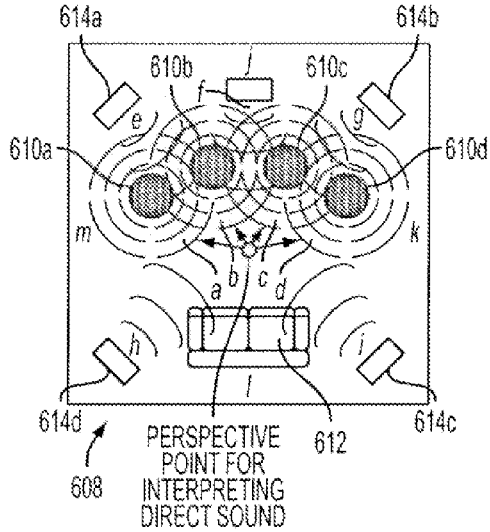

FIG. 6D illustrates an exemplary embodiment of a composite rendering engine 608 that may include one or more nearfield rendering engines 610 (illustrated as nearfield rendering engine 610*a*, nearfield rendering engine 610*b*, nearfield rendering engine 610*c*, and nearfield rendering engine 610*d*) for nearfield articulation, which may be customizable and discretized. Bringing nearfield engines 610*a*-610*d* closer to a listening area 612 may add presence and clarity to an overall articulation process. Volumetric discretization of nearfield rendering engines 610*a*-610*d* within a reproduced sound event may not only help to establish a more stable physical sound stage, it may also enable customization of direct sound articulation, object by object if necessary. This may enhance an overall resolution, since sounds may have unique articulation attributes in terms of wave attributes, scale, directivity, etc. the nuances of which get magnified when intensity is increased.

In various embodiments of the invention, composite rendering engine 608 may include one or more farfield rendering engines 614 (illustrate as farfield rendering engine 614*a*, farfield rendering engine 614*b*, farfield rendering engine 614*c*, and farfield rendering engine 614*d*). The farfield rendering engines 614*a*-614*d* may provide a plurality of micro object volumes included within a macro domain related to farfield objects of in a reproduced sound event.

According to one embodiment, the nearfield rendering engines 610*a*-610*d* and the farfield engines 614*a*-614*d* may work together to produce analogs of sound events, captured or specified. Farfield rendering engines 614*a*-614*d* may contribute to this compound approach by articulating farfield objects, such as, farfield sources, ambient effects, reflected sound, and other farfield objects. Other discretized perspectives can also be applied.

Figure 7:
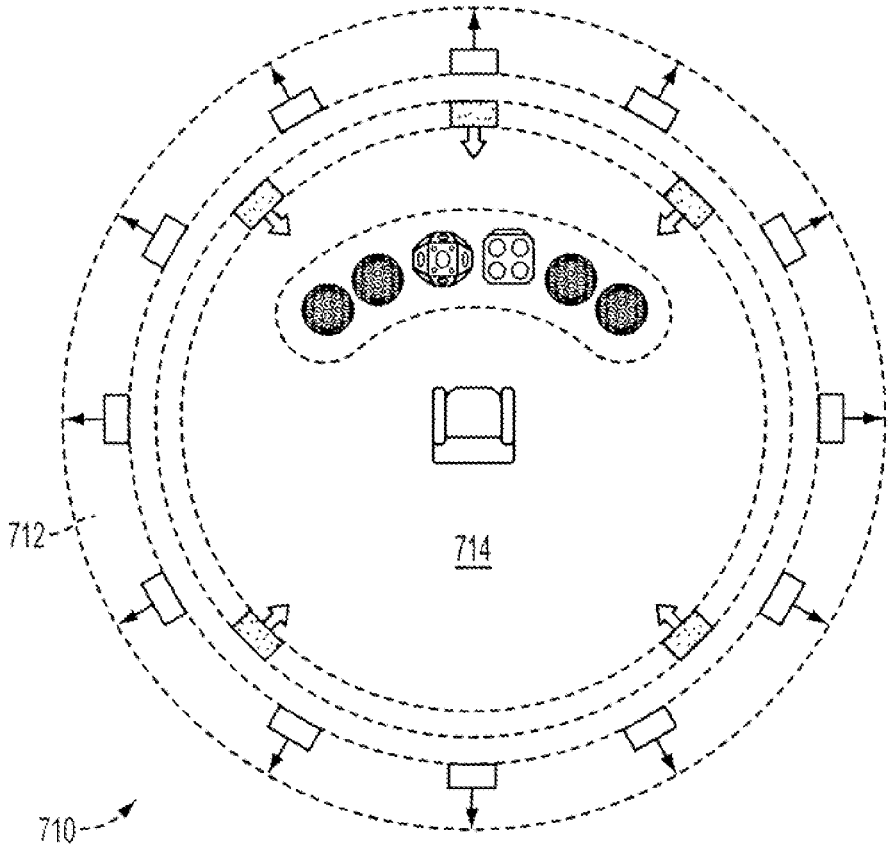
FIG. 7 is an exemplary illustration of a composite sound rendering engine, in accordance with some embodiments of the invention.

FIG. 7 illustrates an exemplary embodiment of a composite rendering engine 710 that may include an exterior noise cancellation engine 712. Exterior noise cancellation engine 712 may be used to counter some or all of a resonance created by an actual playback room 714. By reducing or eliminating the effects of playback room 714, "double ambience" may be reduced or eliminated leaving only the ambience of the original sound event (or of the reproduced event if source material is recorded dry) as opposed to a combined resonating effect created when the ambience of an original event's space is superimposed on the ambience of playback room 714 ("double ambience").

In some embodiments of the invention, some or all of the micro objects included in an original sound event may retain discreteness throughout a transference process including the final transduction process and articulation, or, selected ones of the objects may be mixed if so desired. For instance, to create a derived ambient effect, or be used within a generalized commercial template where a limited number of channels might be available, selected ones of the discretely transferred objects may be mixed prior to articulation. The selection of objects for mixing may be automatic and/or based on user selection. Therefore, the data based functions including control over the object data that corresponds to a sound event may be enhanced to allow for discrete object data (dry or wet) and/or mixed object data (e.g., matrixed according to a perceptually based algorithm, matrixed according to user selection, etc.) to flow through an entire processing chain to compound rendering engine that may include one or more nearfield engines and one or more farfield engines, for final articulation. In other words, object data may be representative of micro objects, such as three- dimensional sound objects, that can be independently articulated (e.g. by micro rendering engines) in addition to being part of a combined macro object.

The virtual vs. real dichotomy (or virtual sound synthesis vs. physical sound synthesis), outlined above, may break down similar to the nearfield-farfield dichotomy. In some embodiments, virtual space synthesis in general may operate well with farfield architectures and physical space synthesis in general may operate well with nearfield architectures (although physical space synthesis may also integrate the use of farfield architectures in conjunction with nearfield architectures). So, the two rendering perspectives may be layered within a volume's space, one for nearfield articulation, the other for farfield articulation, both for macro objects, and both working together to optimize the processes of volumetric amplification among other things. Of course, this example is provided for illustrative purposes only, and other perspectives exist that may enable sound events to be discretized to various levels.

Layering the two articulation paradigms in this manner may augment the overall rendering of sound events, but may also present challenges, such as distinguishing when rendering should change over from virtual to real, or determining where the line between nearfield and farfield may lie. In order for rendering languages to be enabled to deal with these two dichotomies, a standardized template may be established defining nearfield discretization and farfield discretization as a function of layering real and virtual objects (other functions can be defined as well), resulting in a macro-micro rendering template for creating definable repeatable analogs.

Figure 8:
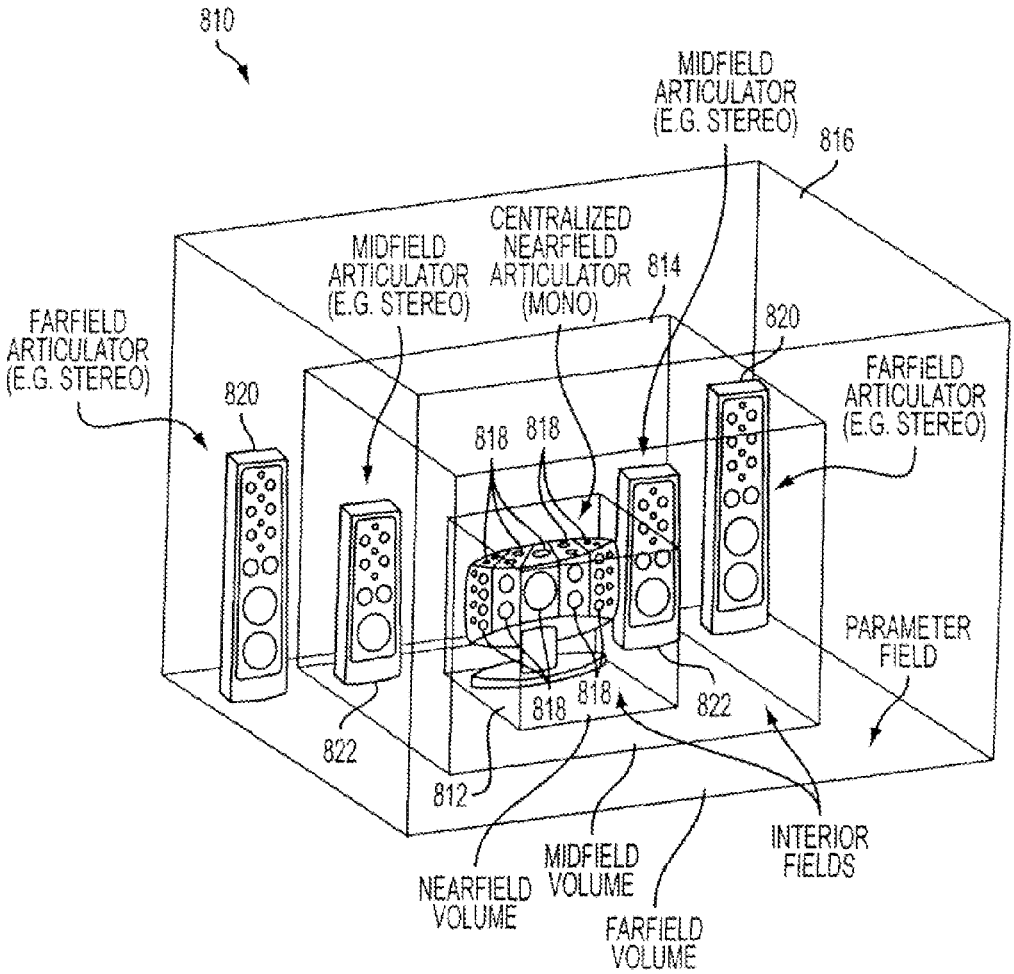
FIG. 8 is an exemplary illustration of a composite sound rendering engine, in accordance with some embodiments of the invention.

FIG. 8 illustrates an exemplary embodiment of a composite rendering engine 810 that may layer a nearfield paradigm 812, a midfield paradigm 814, and a farfield paradigm 816. Nearfield paradigm 812 may include one or more nearfield rendering engines 818. Nearfield engines 818 may be object oriented in nature, and may be used as direct sound articulators. Farfield paradigm 816 may include one or more farfield rendering engines 820. Farfield rendering engines 820 may function as macro rendering engines for accomplishing macro objectives of a reproduced sound event. Farfield rendering engines 820 may be used as indirect sound articulators. Midfield paradigm 814 may include one or more midfield rendering engines 822. Midfield rendering engines 822 may be used as macro rendering engines, as micro rendering engines implemented as micro objects in a reproduced sound event, or to accomplish a combination of macro and micro objectives. By segregating articulation engines for direct and indirect sound, a sound space may be more optimally energized resulting in a more well defined explosive sound event.

According to various embodiments of the invention, composite rendering engine 810 may include using physical space synthesis technologies for nearfield rendering engines 818 while using virtual space synthesis technologies for farfield rendering engines 820. Nearfield rendering engines 818 may be further discretized and customized.

Other embodiments may exist. For example, a primarily physical space synthesis system may be used. In such embodiments, all, or substantially all, aspects of an original sound event may be synthetically cloned and physically reproduced in an appropriately scaled space. However, the compound approach marrying virtual space synthesis and physical space synthesis may provide various enhancements, such as, economic, technical, practical, or other enhancements. However it will be appreciated that if enough space is available within a given playback venue, a sound event may be duplicated using physical space synthesis methods only.

In various embodiments of the invention, object oriented discretization of objects may enable improvements in scaling to take place. For example, if generalizations are required due to budget or space restraints, nearfield scaling issues may enable augmented sound event generation. Farfield sources may be processed and articulated using one or more separate rendering engines, which may also be scaled accordingly. As a result macro events may be reproduced within a given venue (room, car, etc.) using relatively small compound rendering engines designed to match the volume of the venue.

Another aspect of the invention may relate to a transparency of sound reproduction. By discretely controlling some or all of the micro objects included in a sound event, the sound event may be recreated to compensate for one or more component colorizations through equalization as the sound event is reproduced.

Figure 11:
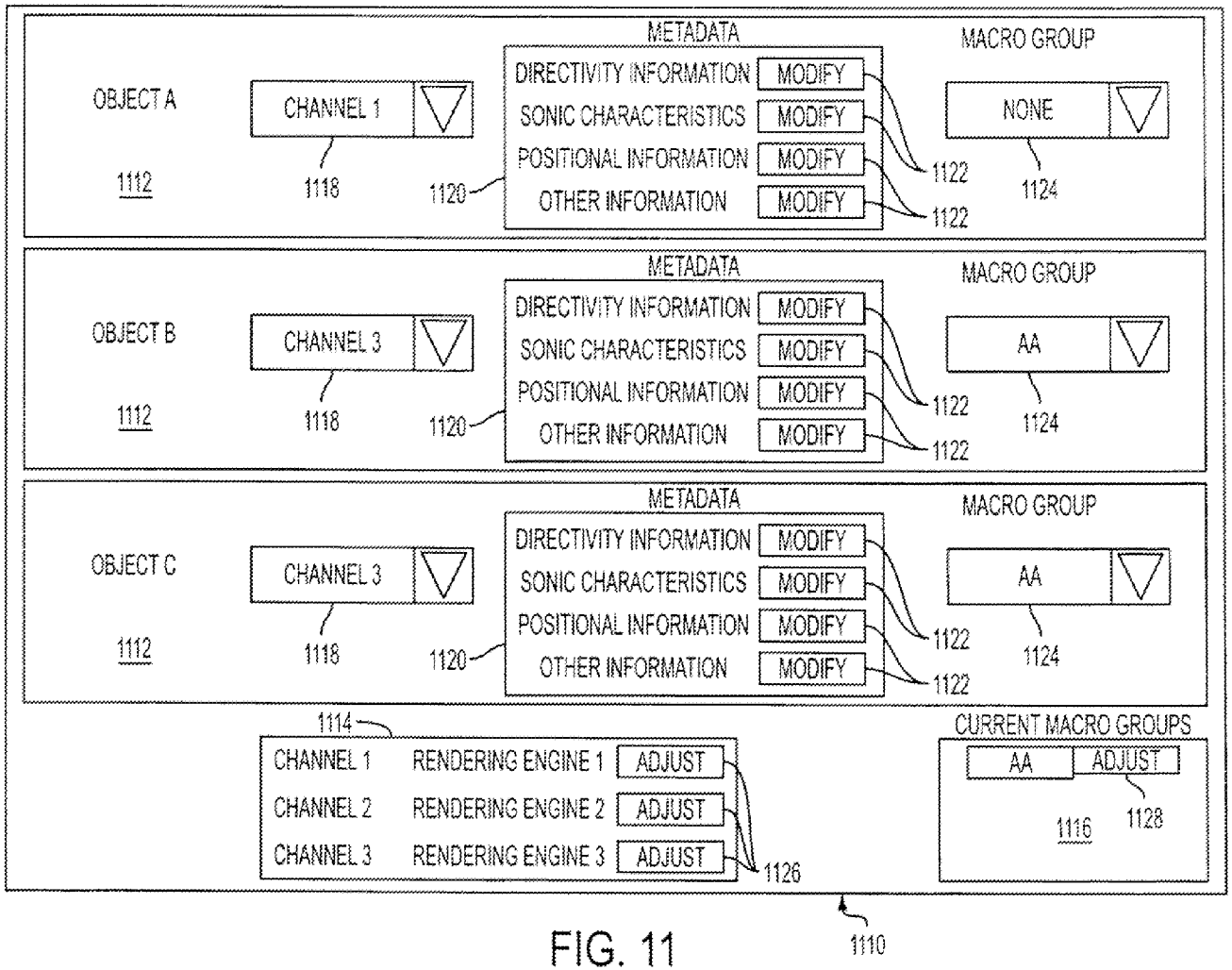
FIG. 11 is an exemplary illustration of a user interface, in accordance with some embodiments of the invention.

FIG. 11 is an exemplary illustration of a user interface 1110, in accordance with some embodiments of the invention. User interface 1110 may include a graphical user interface ("GUI") that may be presented to a user via a computer console, a playback system console, or some other display. The user interface 1110 may enable the user to control a production of a sound event in which one or more sound objects produce sound. In some embodiments of the invention, user interface 1110 may present object information 1112, rendering engine information 1114, and macro grouping information 1116 to the user.

According to various embodiments of the invention, object information 1112 may include information associated with one or more sound objects that produce sounds in the sound event being controlled via user interface 1110. In some embodiments, user interface 1110 may include a mechanism for selecting sound objects, such as a menu, a search window, a button, or another mechanism. Object information 1112 may include a signal path selection mechanism 1118 that enables the user to select a signal path over which a signal may be sent to a rendering engine to drive the rendering engine in accordance with the sound object. Since the rendering engine may be associated with a predetermined signal path, selection of the signal path may enable selection of a rendering engine to be driven in accordance with the sound object. Signal path selection mechanism 1118 may include a menu, a search window, a button, or another mechanism.

In some embodiments, objection information 1112 may include a meta data display 1120. Meta data display 1120 may display meta data associated with the sound object. Meta data may include information about the sound object other than sound content. For example, meta data may include a type of sound source or sound sources associated with the sound object (e.g., a musical instrument type), a directivity pattern of the sound source, positional information (e.g., coordinate position, velocity, acceleration, rotational orientation, etc.) of the sound source during the sound event, sonic characteristics (e.g., an amplitude, a frequency range, a phase, a timbre, etc.) of the sound source, or other information associated with the sound source. Some or all of the meta data associated with the sound source may be captured along with sound content (in instances in which the sound event was pre-recorded), may be specified by a user downstream from sound content capture, or otherwise obtained. For example, meta data may include the INTEL data and meta data described in the related U.S. Provisional Patent Application Ser. No. 60/414,423, filed Sep. 30, 2002, and entitled "System and Method for Integral Transference of Acoustical Events." In some embodiments, meta data display 1120 may include one or more meta data modification mechanisms 1122 that enable the user to modify the meta data associated with the sound object. In some embodiments, modification mechanisms 1122 may enable the user to independently modify the meta data for one of the sound objects relative to the meta data of others of the sound objects.

In some embodiments of the invention, object information 1112 may include a macro grouping mechanism 1124. Macro grouping mechanism may enable one or more of the sound objects displayed in user interface 1110 to be grouped into a macro sound object. Macro grouping mechanism 1124 may include a menu, a search window, a button, or other mechanisms for grouping the sound objects.

According to various embodiments of the invention, rendering engine information 1114 may present information regarding one or more sound rendering engines driven to produce the sound event. For example, rendering engine information 1114 may include which signal paths are associated with which rendering engines, meta data regarding the rendering engines (e.g., directivity pattern, positional information, sonic characteristics, loudspeaker type, amplifier type, etc.), or other information associated with the rendering engines. In some embodiments, rendering engine information 1114 may include one or more rendering engine adjustment mechanisms 1126. Rendering engine adjustment mechanisms 1126 may include a menu (e.g., a pop-up menu, a drop-down menu, etc.), a button, or another mechanism to provide control over the rendering engines. In some instances, rendering engine adjustment mechanisms 1126 may provide access to a dynamic controller for controlling the rendering engines. The dynamic controller may be similar to the dynamic controller disclosed in U.S. patent application Ser. No. 08/749,766, filed Dec. 20, 1996, and entitled "Sound System and Method for Capturing and Reproducing Sounds Originating From a Plurality of Sound Sources."

In some embodiments of the invention, macro grouping information 1116 may display information related to groupings of sound objects grouped into macro sound objects. In some instances, macro grouping information 1116 may include a macro object adjustment mechanism 1128. Macro object adjustment mechanism 1128 may include a menu (e.g., a pop-up menu, a drop-down menu, etc.), a button, or another mechanism to provide control over the rendering engines. Macro object adjustment mechanism 1128 may enable adjustment of a macro sound object formed from a group of the sound objects. For example, macro object adjustment mechanism 1128 may enable coordinated control of the sound objects (e.g., via modification of meta-data, etc.) to independently control the macro sound object relative to sound objects not included in the macro sound object. In some embodiments, macro object adjustment mechanism 1128 may enable coordinated control of the rendering engine, or rendering engines, that are driven according to the sound objects included in the macro sound object to independently control the macro sound object relative to sound objects not included in the macro sound object.

Figure 12:
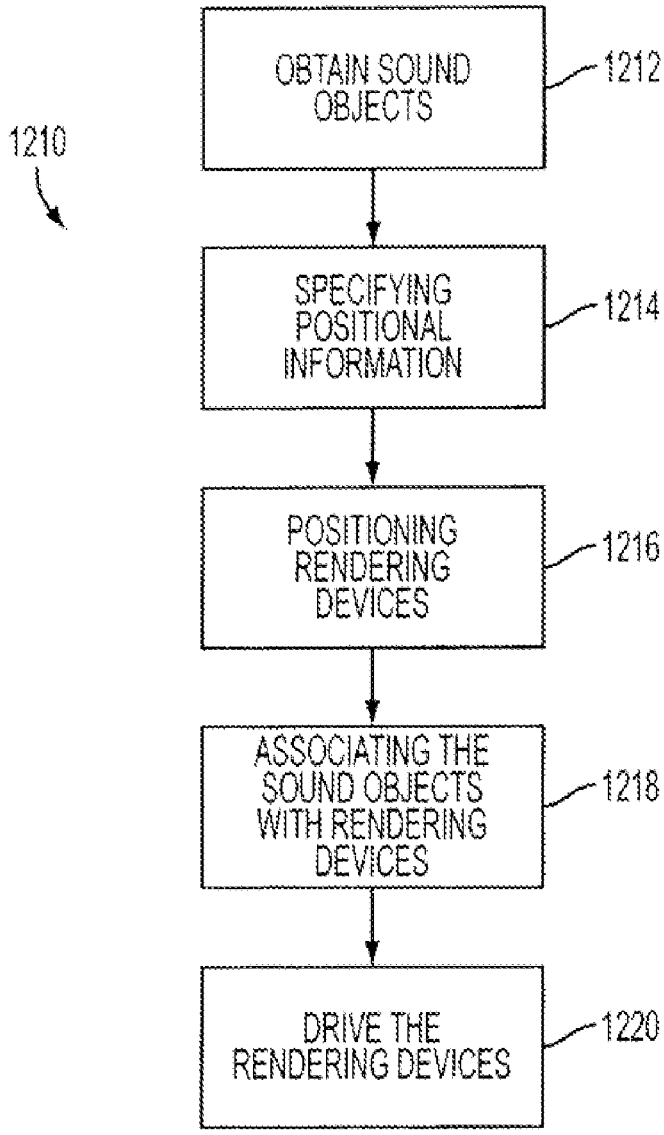
FIG. 12 illustrates a method of producing a sound event according to some embodiments of the invention.

FIG. 12 illustrates a method 1210 of producing a sound event within a volume, the sound event comprising sounds from two or more sound objects. At an operation 1212 sound objects that emit sounds during the sound event are obtained. Obtaining the sound objects may include obtaining information related to the sound objects during the sound event. For example, the information related to the sound objects may include meta data associated with the sound objects, sound content produced by the sound objects during the sound event, or other information. The information related to the sound event may be obtained from an electronically readable storage medium, may be specified by a user, or may be otherwise obtained.

At an operation 1214 positional information for the obtained objects may be specified. In some instances, positional information may be specified within the information obtained at operation 1212. In these instances, the positional information may be adjusted by the user. In other instances, the positional information may be specified by the user.

At an operation 1216 one or more rendering devices may be positioned. The rendering devices may be positioned so as to correspond with the positional information for the sound objects. In some embodiments, the rendering devices may be positioned so as to correspond with anticipated positional information for the sound objects. For example, one or more rendering devices may be positioned in a centralized location to correspond to where a performer would be positioned during a performance. In other embodiments, the rendering devices may be positioned subsequent to the obtaining of the positional information of the sound objects, and may be positioned to precisely coincide with the positions of the sound objects during the sound event.

At an operation 1218 the sound objects may be associated with the rendering devices. In some embodiments, the sound objects may be associated with the rendering devices based on the characteristics of the sound objects and the rendering devices, such as, for example, the positions of the sound objects and the rendering devices, the sonic characteristics of the sound objects and the rendering devices, the directivity patterns of the rendering devices and the sound objects, or other characteristics of the sound objects and the rendering devices.

At an operation 1220 the rendering devices may be driven in accordance with the associated sound objects to produce the sound event. In some embodiments of the invention, driving the rendering devices may include dynamically and individually controlling the rendering devices. The rendering devices may be controlled based on one or more of user selection, the information obtained for the sound objects, or other considerations.

Figure 1:
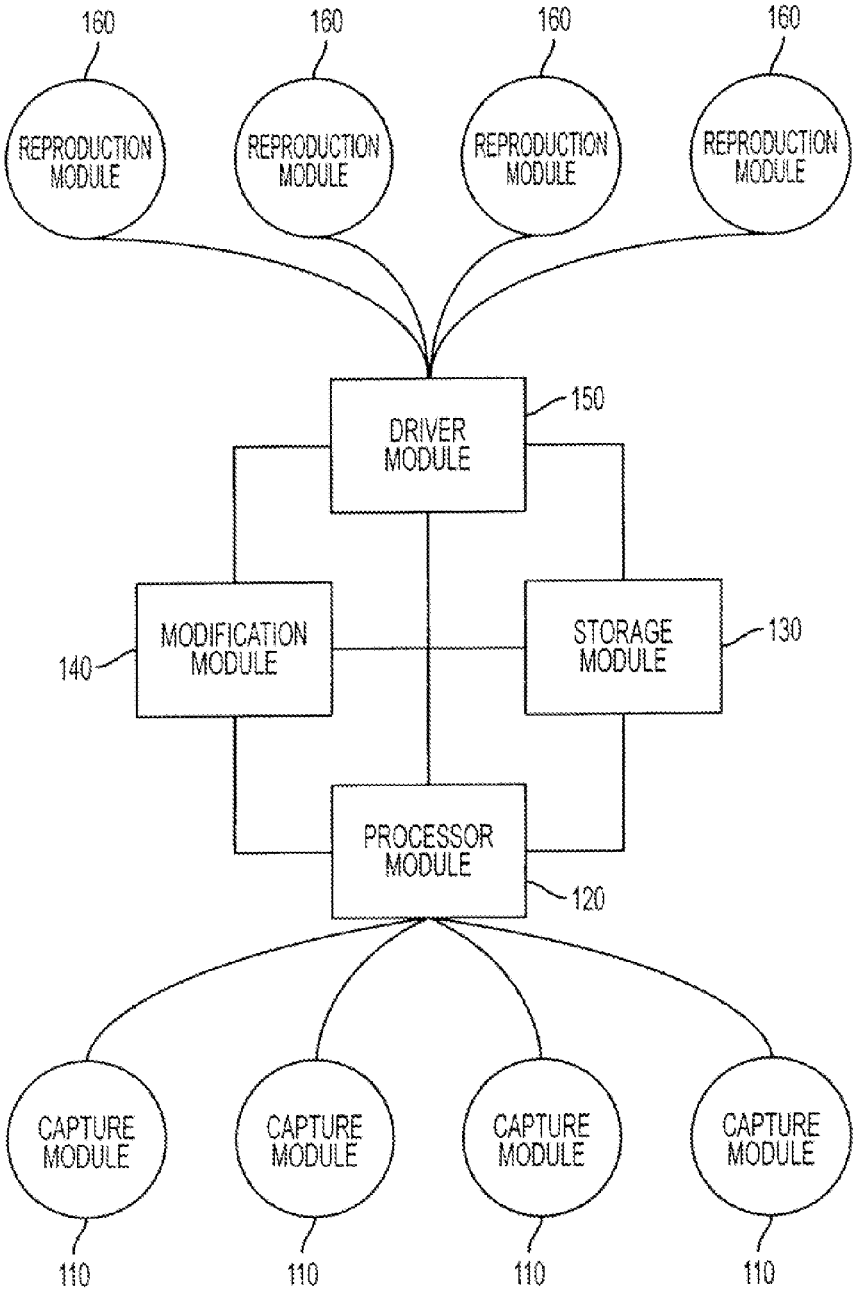
FIG. 1 is a schematic of a system according to an embodiment of the present invention.

FIG. 1 illustrates a system according to an embodiment of the invention. Capture module 110 may enclose sound sources and capture a resultant sound. According to an embodiment of the invention, capture module 110 may comprise a plurality of enclosing surfaces Γa, with each enclosing surface Γa associated with a sound source. Sounds may be sent from capture module 110 to processor module 120. According to an embodiment of the invention, processor module 120 may be a central processing unit (CPU) or other type of processor. Processor module 120 may perform various processing functions, including modeling sound received from capture module 110 based on predetermined parameters (e.g., amplitude, frequency, direction, formation, time, etc.). Processor module 120 may direct information to storage module 130. Storage module 130 may store information, including modeled sound. Modification module 140 may permit captured sound to be modified. Modification may include modifying volume, amplitude, directionality, and other parameters. Driver module 150 may instruct reproduction modules 160 to produce sounds according to a model. According to an embodiment of the invention, reproduction module 160 may be a plurality of amplification devices and loudspeaker clusters, with each loudspeaker cluster associated with a sound source. Other configurations may also be used. The components of FIG. 1 will now be described in more detail.

Figure 2:
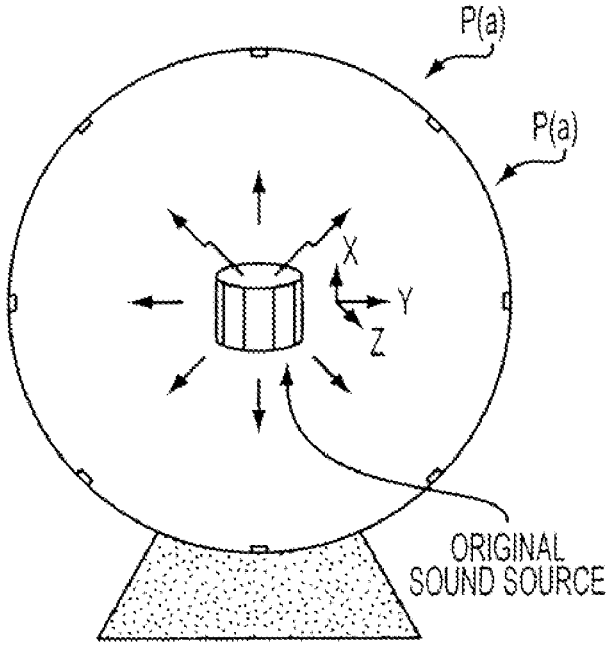
FIG. 2 is a perspective view of a capture module for capturing sound according to an embodiment of the present invention.

FIG. 2 depicts a capture module 110 for implementing an embodiment of the invention. As shown in the embodiment of FIG. 2, one aspect of the invention comprises at least one sound source located within an enclosing (or partially enclosing) surface Γa, which for convenience is shown to be a sphere. Other geometrically shaped enclosing surface Γa configurations may also be used. A plurality of transducers are located on the enclosing surface Γa at predetermined locations. The transducers are preferably arranged at known locations according to a predetermined spatial configuration to permit parameters of a sound field produced by the sound source to be captured. More specifically, when the sound source creates a sound field, that sound field radiates outwardly from the source over substantially 360°. However, the amplitude of the sound will generally vary as a function of various parameters, including perspective angle, frequency and other parameters. That is to say that at very low frequencies (~20 Hz), the radiated sound amplitude from a source such as a speaker or a musical instrument is fairly independent of perspective angle (omni-directional). As the frequency is increased, different directivity patterns will evolve, until at very high frequency (~20 kHz), the sources are very highly directional. At these high frequencies, a typical speaker has a single, narrow lobe of highly directional radiation centered over the face of the speaker, and radiates minimally in the other perspective angles. The sound field can be modeled at an enclosing surface Γa by determining various sound parameters at various locations on the enclosing surface Γa. These parameters may include, for example, the amplitude (pressure), the direction of the sound field at a plurality of known points over the enclosing surface and other parameters.

According to one embodiment of the present invention, when a sound field is produced by a sound source, the plurality of transducers measures predetermined parameters of the sound field at predetermined locations on the enclosing surface over time. As detailed below, the predetermined parameters are used to model the sound field.

Figure 3:
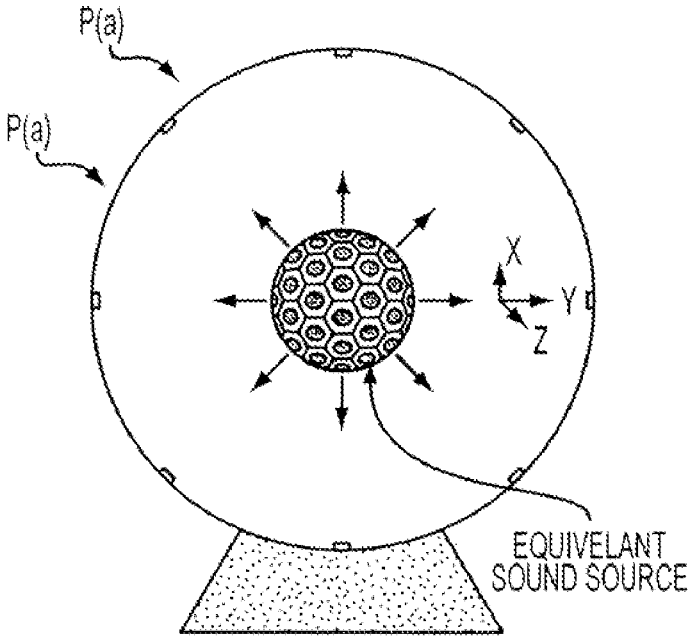
FIG. 3 is a perspective view of a reproduction module according to an embodiment of the present invention.

For example, assume a spherical enclosing surface Γa with N transducers located on the enclosing surface Γa. Further consider a radiating sound source surrounded by the enclosing surface, Γa (FIG. 2). The acoustic pressure on the enclosing surface Γa due to a soundfield generated by the sound source will be labeled P(a). It is an object to model the sound field so that the sound source can be replaced by an equivalent source distribution such that anywhere outside the enclosing surface Γa, the sound field, due to a sound event generated by the equivalent source distribution, will be substantially identical to the sound field generated by the actual sound source (FIG. 3). This can be accomplished by reproducing acoustic pressure P(a) on enclosing surface Γa with sufficient spatial resolution. If the sound field is reconstructed on enclosing surface Γa, in this fashion, it will continue to propagate outside this surface in its original manner.

While various types of transducers may be used for sound capture, any suitable device that converts acoustical data (e.g., pressure, frequency, etc.) into electrical, or optical data, or other usable data format for storing, retrieving, and transmitting acoustical data" may be used.

Processor module 120 may be central processing unit (CPU) or other processor. Processor module 120 may perform various processing functions, including modeling sound received from capture module 110 based on predetermined parameters (e.g., amplitude, frequency, direction, formation, time, etc.), directing information, and other processing functions. Processor module 120 may direct information between various other modules within a system, such as directing information to one or more of storage module 130, modification module 140, or driver module 150.

Storage module 130 may store information, including modeled sound. According to an embodiment of the invention, storage module may store a model, thereby allowing the model to be recalled and sent to modification module 140 for modification, or sent to driver module 150 to have the model reproduced.

Modification module 140 may permit captured sound to be modified. Modification may include modifying volume, amplitude, directionality, and other parameters. While various aspects of the invention enable creation of sound that is substantially identical to an original sound field, purposeful modification may be desired. Actual sound field models can be modified, manipulated, etc. for various reasons including customized designs, acoustical compensation factors, amplitude extension, macro/micro projections, and other reasons. Modification module 140 may be software on a computer, a control board, or other devices for modifying a model.

Driver module 150 may instruct reproduction modules 160 to produce sounds according to a model. Driver module 150 may provide signals to control the output at reproduction modules 160. Signals may control various parameters of reproduction module 160, including amplitude, directivity, and other parameters. FIG. 3 depicts a reproduction module 160 for implementing an embodiment of the invention. According to an embodiment of the invention, reproduction module 160 may be a plurality of amplification devices and loudspeaker clusters, with each loudspeaker cluster associated with a sound source.

Preferably there are N transducers located over the enclosing surface Γa of the sphere for capturing the original sound field and a corresponding number N of transducers for reconstructing the original sound field. According to an embodiment of the invention, there may be more or less transducers for reconstruction as compared to transducers for capturing. Other configurations may be used in accordance with the teachings of the present invention.

Figure 4:
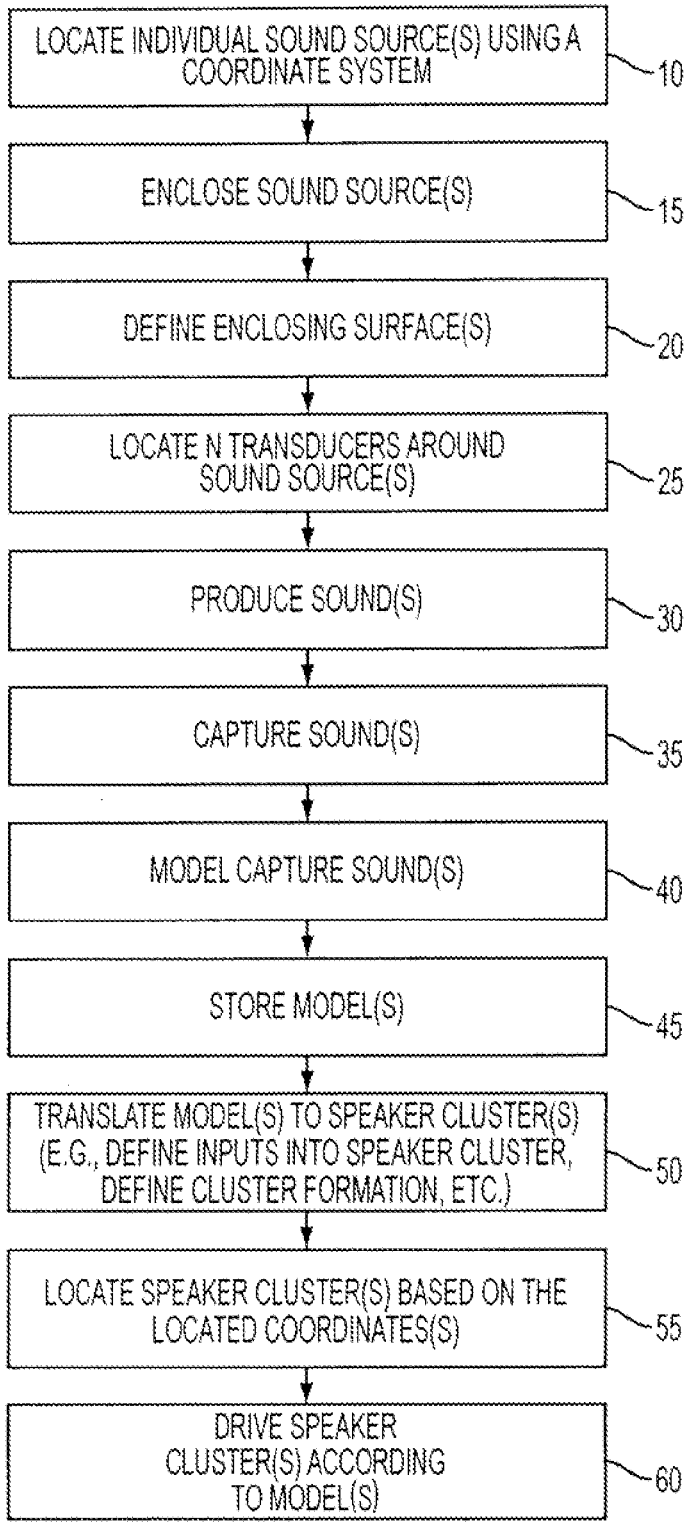
FIG. 4 is a flow chart illustrating operation of a sound field representation and reproduction system according to an embodiment of the present invention.

FIG. 4 illustrates a flow-chart according to an embodiment of the invention wherein a number of sound sources are captured and recreated. Individual sound source(s) may be located using a coordinate system at step 10. Sound source(s) may be enclosed at step 15, enclosing surface Γa may be defined at step 20, and N transducers may be located around enclosed sound source(s) at step 25. According to an embodiment of the invention, as illustrated in FIG. 2, transducers may be located on the enclosing surface Γa. Sound(s) may be produced at step 30, and sound(s) may be captured by transducers at step 35. Captured sound(s) may be modeled at step 40, and model(s) may be stored at step 45. Model(s) may be translated to speaker cluster(s) at step 50. At step 55, speaker cluster(s) may be located based on located coordinate(s). According to an embodiment of the invention, translating a model may comprise defining inputs into a speaker cluster. At step 60, speaker cluster(s) may be driven according to each model, thereby producing a sound. Sound sources may be captured and recreated individually (e.g., each sound source in a band is individually modeled) or in groups. Other methods for implementing the invention may also be used.

According to an embodiment of the invention, as illustrated in FIG. 2, sound from a sound source may have components in three dimensions. These components may be measured and adjusted to modify directionality. For this reproduction system, it is desired to reproduce the directionality aspects of a musical instrument, for example, such that when the equivalent source distribution is radiated within some arbitrary enclosure, it will sound just like the original musical instrument playing in this new enclosure. This is different from reproducing what the instrument would sound like if one were in fifth row center in Carnegie Hall within this new enclosure. Both can be done, but the approaches are different. For example, in the case of the Carnegie Hall situation, the original sound event contains not only the original instrument, but also its convolution with the concert hail impulse response. This means that at the listener location, there is the direct field (or outgoing field) from the instrument plus the reflections of the instrument off the walls of the hail, coming from possibly all directions over time. To reproduce this event within a playback environment, the response of the playback environment should be canceled through proper phasing, such that substantially only the original sound event remains. However, we would need to fit a volume with the inversion, since the reproduced field will not propagate as a standing wave field which is characteristic of the original sound event (i.e., waves going in many directions at once). If, however, it is desired to reproduce the original instrument's radiation pattern without the reverberatory effects of the concert hail, then the field will be made up of outgoing waves (from the source), and one can fit the outgoing field over the surface of a sphere surrounding the original instrument. By obtaining the inputs to the array for this case, the field will propagate within the playback environment as if the original instrument were actually playing in the playback room.

So, the two cases are as follows:

1. To reproduce the Carnegie Hall event, one needs to know the total reverberatory sound field within a volume, and fit that field with the array subject to spatial Nyquist convergence criteria. There would be no guarantee however that the field would converge anywhere outside this volume.

2. To reproduce the original instrument alone, one needs to know the outgoing (or propagating) field only over a circumscribing sphere, and fit that field with the array subject to convergence criteria on the sphere surface. If this field is fit with sufficient convergence, the field will continue to propagate within the playback environment as if the original instrument were actually playing within this volume.

Thus, in one case, an outgoing sound field on enclosing surface Γa has either been obtained in an anechoic environment or reverberatory effects of a bounding medium have been removed from the acoustic pressure P(a). This may be done by separating the sound field into its outgoing and incoming components. This may be performed by measuring the sound event, for example, within an anechoic environment, or by removing the reverberatory effects of the recording environment in a known manner. For example, the reverberatory effects can be removed in a known manner using techniques from spherical holography. For example, this requires the measurement of the surface pressure and velocity on two concentric spherical surfaces. This will permit a formal decomposition of the fields using spherical harmonics, and a determination of the outgoing and incoming components comprising the reverberatory field. In this event, we can replace the original source with an equivalent distribution of sources within enclosing surface Γa. Other methods may also be used.

By introducing a function $H_{ij}(\omega)$, and defining it as the transfer function between source point "i" (of the equivalent source distribution) to field point "j" (on the enclosing surface Γa), and denoting the column vector of inputs to the sources $\chi_i(\omega)$, i=1, 2 . . . N, as X, the column vector of acoustic pressures $P(a)_j$ j=1, 2, . . . N, on enclosing surface Γa as P, and the N×N transfer function matrix as H, then a solution for the independent inputs required for the equivalent source distribution to reproduce the acoustic pressure P(a) on enclosing surface Γa may be expressed as follows $$X=H^{-1}P. \quad \text{(Eqn. 1)}$$

Given a knowledge of the acoustic pressure P(a) on the enclosing surface Γa, and a knowledge of the transfer function matrix (H), a solution for the inputs X may be obtained from Eqn. (1), subject to the condition that the matrix $H^{-1}$ is nonsingular.

The spatial distribution of the equivalent source distribution may be a volumetric array of sound sources, or the array may be placed on the surface of a spherical structure, for example, but is not so limited. Determining factors for the relative distribution of the source distribution in relation to the enclosing surface Γa may include that they lie within enclosing surface Γa, that the inversion of the transfer function matrix, $H^{-1}$, is nonsingular over the entire frequency range of interest, or other factors. The behavior of this inversion is connected with the spatial situation and frequency response of the sources through the appropriate Green's Function in a straightforward manner.

The equivalent source distributions may comprise one or more of:

a) piezoceramic transducers, b) Polyvinyldine Flouride (PVDF) actuators, c) Mylar sheets, d) vibrating panels with specific modal distributions, e) standard electroacoustic transducers, with various responses, including frequency, amplitude, and other responses, sufficient for the specific requirements (e.g., over a frequency range from about 20 Hz to about 20 kHz.

Concerning the spatial sampling criteria in the measurement of acoustic pressure P(a) on the enclosing surface Γa, from Nyquist sampling criteria, a minimum requirement may be that a spatial sample be taken at least one half the highest wavelength of interest. For 20 kHz in air, this requires a spatial sample to be taken every 8 mm. For a spherical enclosing Γa surface of radius 2 meters, this results in approximately 683,600 sample locations over the entire surface. More or less may also be used.

Concerning the number of sources in the equivalent source distribution for the reproduction of acoustic pressure P(a), it is seen from Eqn. (1) that as many sources may be required as there are measurement locations on enclosing surface Γa. According to an embodiment of the invention, there may be more or less sources when compared to measurement locations. Other embodiments may also be used.

Concerning the directivity and amplitude variational capabilities of the array, it is an object of this invention to allow for increasing amplitude while maintaining the same spatial directivity characteristics of a lower amplitude response. This may be accomplished in the manner of solution as demonstrated in Eqn. 1, wherein now we multiply the matrix P by the desired scalar amplitude factor, while maintaining the original, relative amplitudes of acoustic pressure P(a) on enclosing surface Γa.

It is another object of this invention to vary the spatial directivity characteristics from the actual directivity pattern. This may be accomplished in a straightforward manner as in beam forming methods.

According to another aspect of the invention, the stored model of the sound field may be selectively recalled to create a sound event that is substantially the same as, or a purposely modified version of, the modeled and stored sound. As shown in FIG. 3, for example, the created sound event may be implemented by defining a predetermined geometrical surface (e.g., a spherical surface) and locating an array of loudspeakers over the geometrical surface. The loudspeakers are preferably driven by a plurality of independent inputs in a manner to cause a sound field of the created sound event to have desired parameters at an enclosing surface (for example a spherical surface) that encloses (or partially encloses) the loudspeaker array. In this way, the modeled sound field can be recreated with the same or similar parameters (e.g., amplitude and directivity pattern) over an enclosing surface. Preferably, the created sound event is produced using an explosion type sound source, i.e., the sound radiates outwardly from the plurality of loudspeakers over 360° or some portion thereof.

One advantage of the present invention is that, once a sound source has been modeled for a plurality of sounds and a sound library has been established, the sound reproduction equipment can be located where the sound source used to be to avoid the need for the sound source, or to duplicate the sound source, synthetically as many times as desired.

The present invention takes into consideration the magnitude and direction of an original sound field over a spherical, or other surface, surrounding the original sound source. A synthetic sound source (for example, an inner spherical speaker cluster) can then reproduce the precise magnitude and direction of the original sound source at each of the individual transducer locations. The integral of all of the transducer locations (or segments) mathematically equates to a continuous function which can then determine the magnitude and direction at any point along the surface, not just the points a which the transducers are located.

According to another embodiment of the invention, the accuracy of a reconstructed sound field can be objectively determined by capturing and modeling the synthetic sound event using the same capture apparatus configuration and process as used to capture the original sound event. The synthetic sound source model can then be juxtaposed with the original sound source model to determine the precise differentials between the two models. The accuracy of the sonic reproduction can be expressed as a function of the differential measurements between the synthetic sound source model and the original sound source model. According to an embodiment of the invention, comparison of an original sound event model and a created sound event model may be performed using processor module 120.

Alternatively, the synthetic sound source can be manipulated in a variety of ways to alter the original sound field. For example, the sound projected from the synthetic sound source can be rotated with respect to the original sound field without physically moving the spherical speaker cluster. Additionally, the volume output of the synthetic source can be increased beyond the natural volume output levels of the original sound source. Additionally, the sound projected from the synthetic sound source can be narrowed or broadened by changing the algorithms of the individually powered loudspeakers within the spherical network of loudspeakers. Various other alterations or modifications of the sound source can be implemented.

By considering the original sound source to be a point source within an enclosing surface Γa, simple processing can be performed to model and reproduce the sound.

According to an embodiment, the sound capture occurs in an anechoic chamber or an open air environment with support structures for mounting the encompassing transducers. However, if other sound capture environments are used, known signal processing techniques can be applied to compensate for room effects. However, with larger numbers of transducers, the "compensating algorithms" can be somewhat more complex.

Once the playback system is designed based on given criteria, it can, from that point forward, be modified for various purposes, including compensation for acoustical deficiencies within the playback venue, personal preferences, macro/micro projections, and other purposes. An example of macro/micro projection is designing a synthetic sound source for various venue sizes. For example, a macro projection may be applicable when designing a synthetic sound source for an outdoor amphitheater. A micro projection may be applicable for an automobile venue. Amplitude extension is another example of macro/micro projection. This may be applicable when designing a synthetic sound source to perform 10 or 20 times the amplitude (loudness) of the original sound source. Additional purposes for modification may be narrowing or broadening the beam of projected sound (i.e., 360° reduced to 180°, etc.), altering the volume, pitch, or tone to interact more efficiently with the other individual sound sources within the same sound field, or other purposes.

The present invention takes into consideration the "directivity characteristics" of a given sound source to be synthesized. Since different sound sources (e.g., musical instruments) have different directivity patterns the enclosing surface and/or speaker configurations for a given sound source can be tailored to that particular sound source. For example, horns are very directional and therefore require much more directivity resolution (smaller speakers spaced closer together throughout the outer surface of a portion of a sphere, or other geometric configuration), while percussion instruments are much less directional and therefore require less directivity resolution (larger speakers spaced further apart over the surface of a portion of a sphere, or other geometric configuration).

According to another embodiment of the invention, a computer usable medium having computer readable program code embodied therein for an electronic competition may be provided. For example, the computer usable medium may comprise a CD ROM, a floppy disk, a hard disk, or any other computer usable medium. One or more of the modules of system 100 may comprise computer readable program code that is provided on the computer usable medium such that when the computer usable medium is installed on a computer system, those modules cause the computer system to perform the functions described.

According to one embodiment, processor, module 120, storage module 130, modification module 140, and driver module 150 may comprise computer readable code that, when installed on a computer, perform the functions described above. Also, only some of the modules may be provided in computer readable code.

According to one specific embodiment of the present invention, a system may comprise components of a software system. The system may operate on a network and may be connected to other systems sharing a common database. According to an embodiment of the invention, multiple analog systems (e.g., cassette tapes) may operate in parallel to each other to accomplish the objections and functions of the invention. Other hardware arrangements may also be provided.

In some embodiments of the invention, sound may be modeled and synthesized based on an object oriented discretization of a sound volume starting from focal regions inside a volumetric matrix and working outward to the perimeter of the volumetric matrix. An inverse template may be applied for discretizing the perimeter area of the volumetric matrix inward toward a focal region.

In applying volumetric geometry to objectively define volumetric space and direction parameters in terms of the placement of sources, the scale between sources and between room size and source size, the attributes of a given volume or space, movement algorithms for sources, etc., may be done using a variety of evaluation techniques. For example, a method of standardizing the volumetric modeling process may include applying a focal point approach where a point of orientation is defined to be a "focal point" or "focal region" for a given sound volume.

Figure 9A:
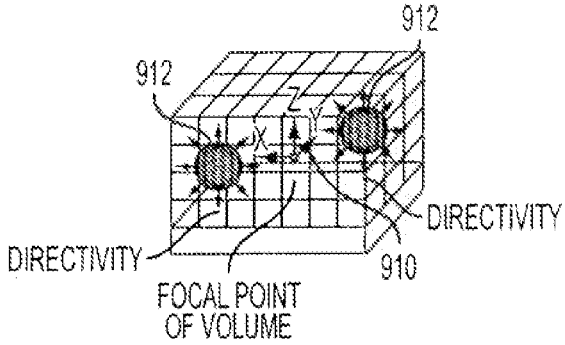
FIG. 9 illustrates several coordinate systems that may be implemented in various embodiments of the invention.
Figure 9B:
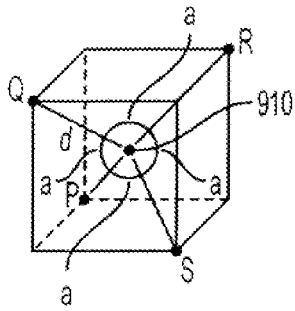
Figure 9C:
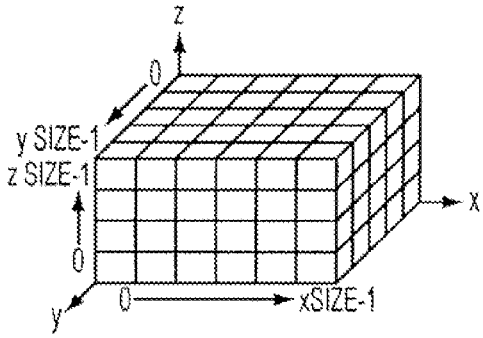

According to various embodiments of the invention, focal point coordinates for any volume may be computed from dimensional data for a given volume which may be measured or assigned. FIG. 9A illustrates an exemplary embodiment of a focal point 910 located amongst one or more micro objects 912 of a sound event. Since a volume may have a common reference point, focal point 910 for example, everything else may be defined using a three dimensional coordinate system with volume focal points serving as a common origin, such as an exemplary coordinate system illustrated in FIG. 9B. Other methods for defining volumetric parameters may be used as well, including a tetrahedral mesh illustrated in FIG. 9C, or other methods. Some or all of the volumetric computation may be performed via computerized processing. Once a volume's macro-micro relationships are determined based on a common reference point (e.g. its focal point), scaling issues may be applied in an objective manner. Data based aspects (e.g. content) can be captured (or defined) and routed separately for rendering via a compound rendering engine.

Figure 10:
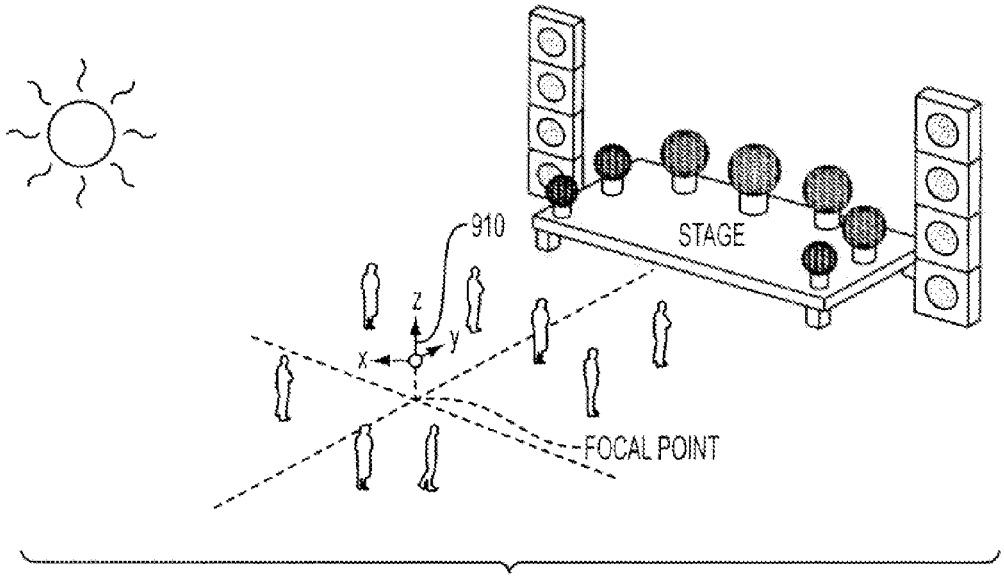
FIG. 10 illustrates a composite sound rendering engine that may be implemented in an outdoor environment according to some embodiments of the invention.

FIG. 10 illustrates an exemplary embodiment that may be implemented in applications that occur in open space without full volumetric parameters (e.g. a concert in an outdoor space), the missing volumetric parameters may be assigned based on sound propagation laws or they may be reduced to minor roles since only ground reflections and intraspace dynamics among sources may be factored into a volumetric equation in terms of reflected sound and other ambient features. However even under these conditions a sound event's focal point 910 (used for scaling purposes among other things) may still be determined by using area dimension and height dimension for an anticipated event location.

By establishing an area based focal point (i.e. focal point 910) with designated height dimensions even outdoor events and other sound events not occurring in a structured volume may be appropriately scaled and translated from reference models.

Other embodiments, uses and advantages of the present invention will be apparent to those skilled in the art from consideration of the specification and practice of the invention disclosed herein. The specification and examples should be considered exemplary only. The intended scope of the invention is only limited by the claims appended hereto.

What is claimed is:

1. A method of producing a sound event within a volume, the sound event comprising sounds from three or more user selectable sound objects, wherein a sound object includes (i) sound content generated by an individual sound source during the sound event and (ii) other information related to the individual sound source, the method comprising:

obtaining at least a first sound object, a second sound object, a third sound object and a fourth sound object separately from each other;

subsequent to obtaining the sound objects, grouping the second sound object and the third sound object into a first macro sound object that is controlled separately from the first sound object and the fourth sound object, and grouping the first sound object and the fourth sound object into a second macro sound object;

associating a first sound rendering device with the first sound object, associating a second sound rendering device with the first macro sound object, and associating the fourth sound object with a third sound rendering device; and driving the first sound rendering device in accordance with the first sound object and driving the second sound rendering device in accordance with the first macro sound object, wherein driving the first sound rendering device in accordance with the first sound object and driving the second sound rendering device in accordance with the first macro sound object further comprises driving the first sound rendering device and the third sound rendering device in accordance with the second macro sound object.

2. The method of claim 1, wherein driving the first and second sound rendering devices comprises independently controlling each of the first and second sound rendering devices.

3. The method of claim 2, wherein independently controlling each of the first and second sound rendering devices comprises independently controlling segments within one or more of the first and second sound rendering devices.

4. The method of claim 3, wherein independently controlling segments within one or more of the first and second sound rendering devices comprises independently controlling nodes within one or more of the segments that are independently controlled.

5. The method of claim 1, wherein each of the first and second sound rendering devices are controlled relative to each other.

6. The method of claim 1, wherein controlling the first and second sound rendering devices comprises controlling at least one of a directivity, a tonal characteristic, an amplitude, a position, or a rotational orientation of one or both of the first and second sound rendering devices.

7. The method of claim 1, wherein grouping the second sound object and the third sound object into the first macro sound object comprises determining which of the first sound object, the second sound object, and/or the third sound object should be grouped into a macro sound object based on the obtained other information related to the individual sound sources corresponding to the first sound object, the second sound object, and the third sound object.

8. The method of claim 7, wherein the obtained other information related to the individual sound sources corresponding to the first sound object, the second sound object, and the third sound object comprises positional information related to the relative positions of the sound source corresponding to the first sound object, the sound source corresponding to the second sound object, and the sound source corresponding to the third sound object during the sound event, and wherein the determination as to which of the first sound object, the second sound object, and/or the third sound object should be grouped is made based on the obtained positional information.

9. The method of claim 1, wherein second rendering device is a virtual rendering engine configured to create a perception of sounds being generated from one or more locations not actually occupied by the second rendering device, and wherein the first rendering device is a physical rendering engine configured to create a perception of sounds being generated from the physical location of the first rendering device.

10. The method of claim 9, wherein the obtained information related to the first sound object, the second sound object, and the third sound object comprises information indicating whether individual ones of the sound sources corresponding to the first sound object, the second sound object, and the third sound object should be rendered via a virtual sound rendering engine or a physical sound rendering engine, and wherein the grouping of the second sound object and the third sound object into the first macro sound object comprises determining which of the first sound object, the second sound object and/or the third sound object should be grouped into a macro sound object based on the obtained information indicating whether individual ones of the sound sources corresponding to the first sound object, the second sound object, and the third sound object should be rendered via a virtual sound rendering engine or a physical sound rendering engine.

11. The method of claim 1, further comprising obtaining information related to the first sound rendering device and the second sound rendering device, and wherein the grouping of the second sound object and the third sound object into the first macro sound object is based on the obtained information related to the first sound rendering device and the second sound rendering device.

12. The method of claim 11, wherein the obtained information related to the first sound rendering device and the second sound rendering device indicates whether the first sound rendering device or the second sound rendering device are (i) a virtual rendering engine configured to create a perception of sounds being generated from one or more locations not actually occupied by the virtual rendering engine, or (ii) a physical rendering engine configured to create a perception of sounds being generated from the physical location of the physical rendering engine.

13. The method of claim 1, wherein the first sound object and the first macro sound object are associated with the sound rendering devices based on at least one of a user selection, positional information for sound sources corresponding to the sound objects, or a sonic characteristic of the sound sources corresponding to the sound objects.

14. The method of claim 1, wherein the sound objects are grouped into the first macro sound object and the second macro sound object based on at least one of a user selection, positional information for sound sources corresponding to the sound objects, or a sonic characteristic of the sound sources corresponding to the sound objects.

15. The method of claim 1, wherein driving the first sound rendering device and the third sound rendering device in accordance with the second macro sound object comprises driving the first sound rendering device in accordance with the first sound object, driving the third sound rendering device in accordance with the fourth sound object, and controlling the coordinated production of sounds associated with the first and fourth sound objects by the first and third sound rendering devices separately from the production of sounds by the second sound rendering device.

16. The method of claim 1, wherein obtaining the first sound object, the second sound object, and the third sound object comprises obtaining, for at least one of the sound sources corresponding to the first sound object, the second sound object, or the third sound object, one or more of a sonic characteristic, positional information, a sound source identity, a sound source type identity, or sound conditioning information.

17. The method of claim 16, wherein a sonic characteristic comprises one or more of a directivity pattern, an amplitude, a frequency range, a phase, or a timbre.

18. The method of claim 17, wherein the positional information for one or more of the sound sources comprises information regarding movement of a sound source corresponding to the first sound object during the sound event.

19. The method of claim 18, wherein the first sound rendering device comprises a plurality of spatially separate loudspeaker arrangements, and wherein driving the first sound rendering device comprises driving the plurality of spatially separate loudspeaker arrangements to reproduce the movement of the sound source corresponding to the first sound object.

20. The method of claim 19, wherein the amplifier comprises a stand alone amplifier or an integrated amplifier.

21. The method of claim 18, wherein driving the first sound rendering device comprises moving the first sound rendering device to reproduce the movement of the sound source corresponding to the first sound object.

22. The method of claim 1, wherein the sound rendering devices comprise a speaker.

23. The method of claim 22, wherein the speaker comprises a single element speaker, a multiple element speaker, a speaker array, a spherical speaker, a scalable speaker, an explosion speaker, or an implosion speaker.

24. The method of claim 1, wherein the sound rendering devices comprise an amplifier.

25. The method of claim 1, wherein each of the sound objects corresponds to a separate musical instrument.

26. A user interface that enables a user to control one or more sound rendering devices to generate a sound event in which one or more sound objects produce sound, the user interface comprising:

an object information interface that displays object information that corresponds to the sound objects, wherein the object information includes associations between individual sound objects and individual rendering devices, meta data that corresponds to individual ones of the sound objects, and macro grouping information that relates to the grouping of selected ones of the sound objects into one or more macro sound objects;

the object information interface enabling the user to modify at least some of the object information that corresponds to individual ones of the sound objects separately from object information that corresponds to the other sound objects, wherein the object information interface enables the user to modify the macro grouping information, wherein modifying the macro grouping information enables the user to independently control one of the macro sound objects independently from the sound objects not grouped in the controlled macro sound object; and a rendering device interface that displays rendering device information associated with the rendering devices, wherein the rendering device information includes meta data that corresponds to individual rendering devices, and operational information that corresponds to individual rendering devices;

the rendering device interface enabling the user to modify at least some of the rendering device information that corresponds to individual ones of the rendering devices separately from rendering device information that corresponds to the other rendering devices.

27. The user interface of claim 26, wherein the meta data that corresponds to individual ones of the sound objects includes one or more of a directivity pattern, a sonic characteristic, a musical instrument type, or positional information.

28. The user interface of claim 27, wherein the meta data that corresponds to individual ones of the sound objects comprises at least one a sonic characteristic, and wherein the at least one sonic characteristic comprises one or more of an amplitude, a frequency range, a phase, or a timbre.

29. The user interface of claim 27, wherein the meta data that corresponds to individual ones of the sound objects includes positional information, and wherein the positional information includes one or more of a location, a velocity, an acceleration, or a rotational orientation.

30. The user interface of claim 26, wherein the meta data that corresponds to individual ones of the rendering devices includes one or more of a directivity pattern, a sonic characteristic, or positional information.

31. The user interface of claim 30, wherein the meta data that corresponds to individual ones of the rendering devices comprises at least one sonic characteristic, and wherein the at least one sonic characteristic includes one or more of an amplitude, a frequency range, a phase, or a timbre.

32. The user interface of claim 30, wherein the meta data that corresponds to individual ones of the rendering devices comprises positional information, and wherein the positional information includes a location, a velocity, an acceleration, or a rotational orientation.

33. The user interface of claim 26,wherein independently controlling one of the macro sound objects includes controlling object information that corresponds to the sound objects grouped into the controlled macro sound object in a coordinated manner.

34. The user interface of claim 26, wherein independently controlling one of the macro sound objects includes controlling rendering device information that corresponds to the rendering devices associated with the sound objects grouped into the controlled macro sound object in a coordinated manner.

35. A system configured to produce a sound event within a volume, the sound event comprising sounds from three or more user selectable sound objects, wherein a sound object includes sound content generated by an individual sound source during the sound event and other information related to the individual sound source, the system comprising:

a processor configured to (i) obtain at least a first sound object, a second sound object, a third sound object, and a fourth sound object separately from each other, (ii) subsequent to obtaining the sound objects, group the second sound object and the third sound object into a first macro sound object that is controlled separately from the first sound object and the fourth sound object, and group the first sound object and the fourth sound object into a second macro sound object, (iii) associate a first sound rendering device with the first sound object, associate a second sound rendering device with the first macro sound object, and associate a third sound rendering device with the fourth sound object, and (iv) drive the first sound rendering device in accordance with the first sound object and drive the second sound rendering device in accordance with the first macro sound object, wherein driving the first sound rendering device in accordance with the first sound object and the second sound rendering device in accordance with the first macro sound object further comprises driving the first sound rendering device and the third sound rendering device in accordance with the second macro sound object.

36. The system of claim 35, wherein driving the first and second sound rendering devices comprises controlling at least one of a directivity, a tonal characteristic, an amplitude, a position, or a rotational orientation of one or both of the first and second sound rendering devices.

37. The system of claim 35, wherein grouping the second sound object and the third sound object into the first macro sound object comprises determining which of the first sound object, the second sound object, and/or the third sound object should be grouped into a macro sound object based on the obtained other information related to the individual sound sources corresponding to the first sound object, the second sound object, and the third sound object.

38. The system of claim 37, wherein the obtained information related to the first sound object, the second sound object, and the third sound object comprises information indicating whether individual ones of the sound sources corresponding to the first sound object, the second sound object, and the third sound object should be rendered via a virtual sound rendering engine or a physical sound rendering engine, and wherein the grouping of the second sound object and the third sound object into the first macro sound object comprises determining which of the first sound object, the second sound object, and/or the third sound object should be grouped into a macro sound object based on the obtained information indicating whether individual ones of the sound sources corresponding to the first sound object, the second sound object, and the third sound object should be rendered via a virtual sound rendering engine or a physical sound rendering engine.

39. The system of claim 35, wherein the processor is further configured to obtain information related to the first sound rendering device and the second sound rendering device, and wherein the grouping of the second sound object and the third sound object into the first macro sound object by the processor is based on the obtained information related to the first sound rendering device and the second sound rendering device.

40. The system of claim 39, wherein the obtained information related to the first sound rendering device and the second sound rendering device indicates whether the first sound rendering device or the second sound rendering device are (i) a virtual rendering engine configured to create a perception of sounds being generated from one or more locations not actually occupied by the virtual rendering engine, or (ii) a physical rendering engine configured to create a perception of sounds being generated from the physical location of the physical rendering engine.

41. The system of claim 35, wherein the first sound object and the first macro sound object are associated with the sound rendering devices by the processor based on at least one of a user selection, positional information for sound sources corresponding to the sound objects, or a sonic characteristic of the sound sources corresponding to the sound objects.

* * * * *